US011234537B2

(12) United States Patent
Cummings et al.

(10) Patent No.: US 11,234,537 B2
(45) Date of Patent: Feb. 1, 2022

(54) FOOD DISPLAY FRICTION HINGE

(71) Applicant: PMG Ventures, Inc., Atlanta, GA (US)

(72) Inventors: Christopher Godbey Cummings, Atlanta, GA (US); Brian Stanley Ozment, Atlanta, GA (US)

(73) Assignee: PMG Ventures, Inc., Atlanta, GA (US)

( * ) Notice: Subject to any disclaimer, the term of this patent is extended or adjusted under 35 U.S.C. 154(b) by 253 days.

(21) Appl. No.: 16/526,028

(22) Filed: Jul. 30, 2019

(65) Prior Publication Data

US 2019/0350386 A1 Nov. 21, 2019

Related U.S. Application Data

(63) Continuation of application No. 15/903,795, filed on Feb. 23, 2018, now Pat. No. 10,405,677.

(60) Provisional application No. 62/463,259, filed on Feb. 24, 2017.

(51) Int. Cl.

| | |
|---|---|
| ***A47F 10/06*** | (2006.01) |
| ***A47F 3/00*** | (2006.01) |
| ***A47B 57/04*** | (2006.01) |
| ***A47B 96/06*** | (2006.01) |

(52) U.S. Cl.

CPC ..... *A47F 10/06* (2013.01); *A47F 3/007* (2013.01); *A47B 57/04* (2013.01); *A47B 96/062* (2013.01); *A47F 2003/008* (2013.01); *A47F 2010/065* (2013.01)

(58) Field of Classification Search

CPC .. A47F 3/007; A47F 3/005; A47F 3/12; A47F 10/06; A47F 2003/008; A47F 2010/065; A47B 57/04; A47B 96/062; F16M 2200/022

See application file for complete search history.

(56) References Cited

U.S. PATENT DOCUMENTS

| | | | |
|---|---|---|---|
| 6,132,018 | A | 10/2000 | McGrath |
| 6,588,863 | B1 | 7/2003 | Yatchak et al. |
| 8,109,579 | B2 | 2/2012 | English et al. |
| 8,403,430 | B2 | 3/2013 | Atkins |
| 8,585,160 | B2 | 11/2013 | Atkins |
| 9,326,621 | B1 | 5/2016 | McCallister et al. |
| 9,516,958 | B1 | 12/2016 | McCallister et al. |
| 9,538,868 | B1 | 1/2017 | Christianson |
| 9,723,935 | B1 | 8/2017 | McCallister et al. |

(Continued)

OTHER PUBLICATIONS

Premier Metal & Glass, Adjustable Food Shields, https://www.pmg-inc.com/adjustable-food-shields (last visited Feb. 22, 2018).

(Continued)

*Primary Examiner* — Andrew M Roersma

(74) *Attorney, Agent, or Firm* — Thomas | Horstemeyer, LLP

(57) ABSTRACT

Various embodiments for a food display that includes a friction hinge capable of retaining and adjusting a panel without a locking mechanism that requires attachments or detachments are disclosed. The food display can include food display posts and a friction hinge attached to at least one of the food display posts. A panel can be coupled to the friction hinge to act as a sneeze or breath guard, where the panel is capable of rotating about the friction hinge when a predetermined amount of force is applied to the panel.

20 Claims, 22 Drawing Sheets

(56) References Cited

U.S. PATENT DOCUMENTS

| | | | | |
|---|---|---|---|---|
| 10,405,677 | B2 * | 9/2019 | Cummings | A47F 3/007 |
| 2004/0184895 | A1 | 9/2004 | Liao | |
| 2011/0169384 | A1 | 7/2011 | Padden et al. | |
| 2016/0235222 | A1 | 8/2016 | Atkins et al. | |
| 2016/0331155 | A1 | 11/2016 | Atkins et al. | |

OTHER PUBLICATIONS

Premier Metal & Glass, Self-Service Guards without Top Shelves, https://www.pmg-inc.com/self-serve-sneeze-guards (last visited Feb. 22, 2018).
Premier Metal & Glass, Full-Service Guards without Top Shelves, https://www.pmg-inc.com/full-service-displays (last visited Feb. 22, 2018).
Premier Metal & Glass, UV Bonded Frameless, https://www.pmg-inc.com/UV-bonded-frameless (last visited Feb. 22, 2018).
Premier Metal & Glass, Fusion Guards, https://www.pmg-inc.com/fusion-guard (last visited Feb. 22, 2018).

* cited by examiner

FOOD DISPLAY FRICTION HINGE

CROSS-REFERENCE TO RELATED APPLICATION

This application is a continuation of U.S. patent application Ser. No. 15/903,795 entitled "FOOD DISPLAY FRICTION HINGE," filed Feb. 23, 2018, which claims the benefit of and priority to U.S. Provisional Patent Application No. 62/463,259 entitled "FOOD DISPLAY AND FRICTION HINGE FOR ROTATING FOOD DISPLAY PANELS," filed on Feb. 24, 2017, the contents of which being incorporated by reference in their entirety herein.

BACKGROUND

Food displays often include panels that act to shield food from human breath particles and airborne bacteria, which are generally referred to as sneeze or breath guards. For instance, clear panels are generally placed on a buffet, salad bar, or similar type of food display to protect food from various forms of potential contamination. Some health and safety codes for various jurisdictions require a shield be placed in a certain position relative to the food display. It is desirable that the panels of the food display be easily adjustable so that the food display can be modified for cleaning or different uses.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
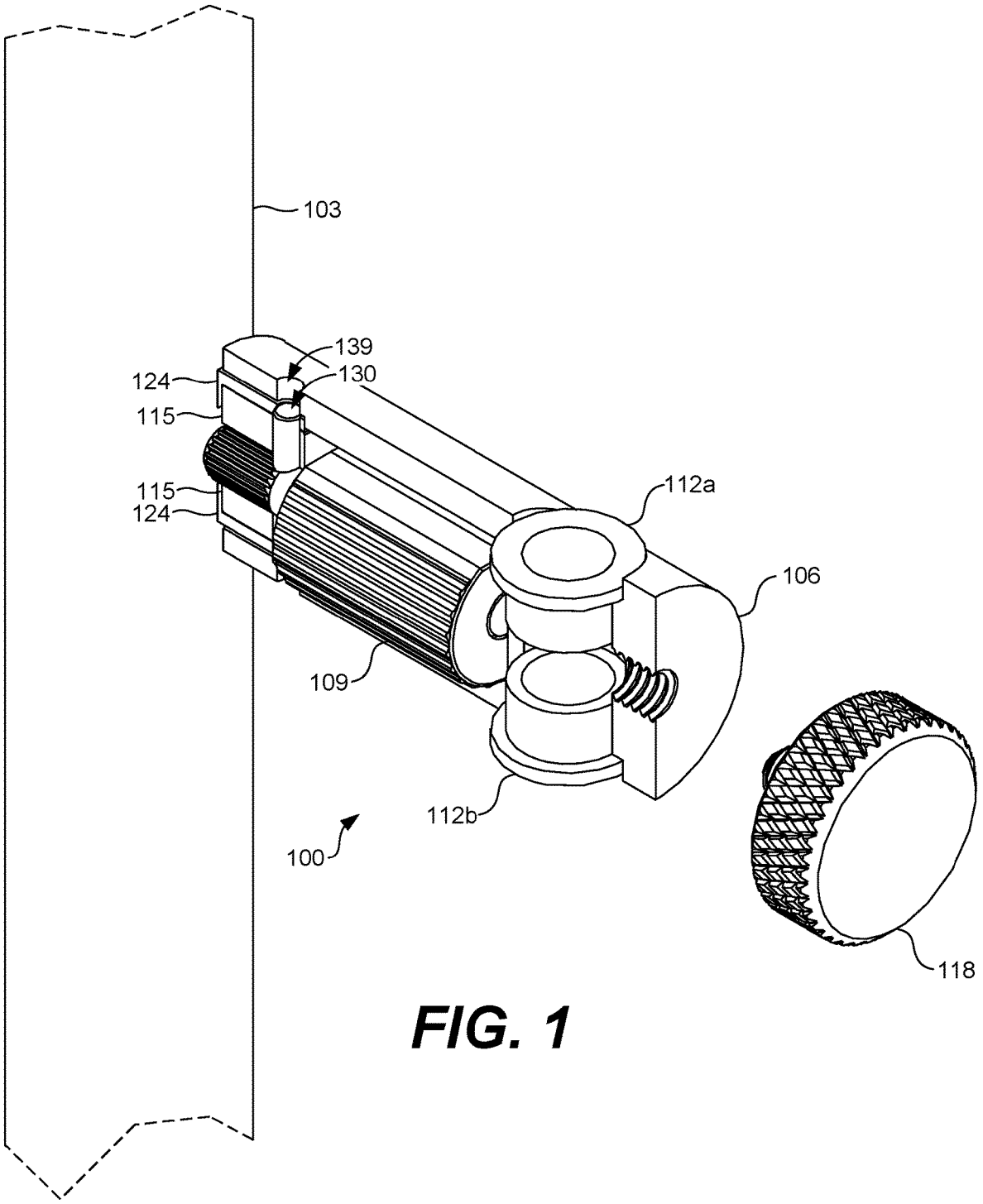
FIG. 1 is a perspective cross-section view of a friction hinge coupled to a food display post according to various embodiments of the present disclosure.
Figure 2:
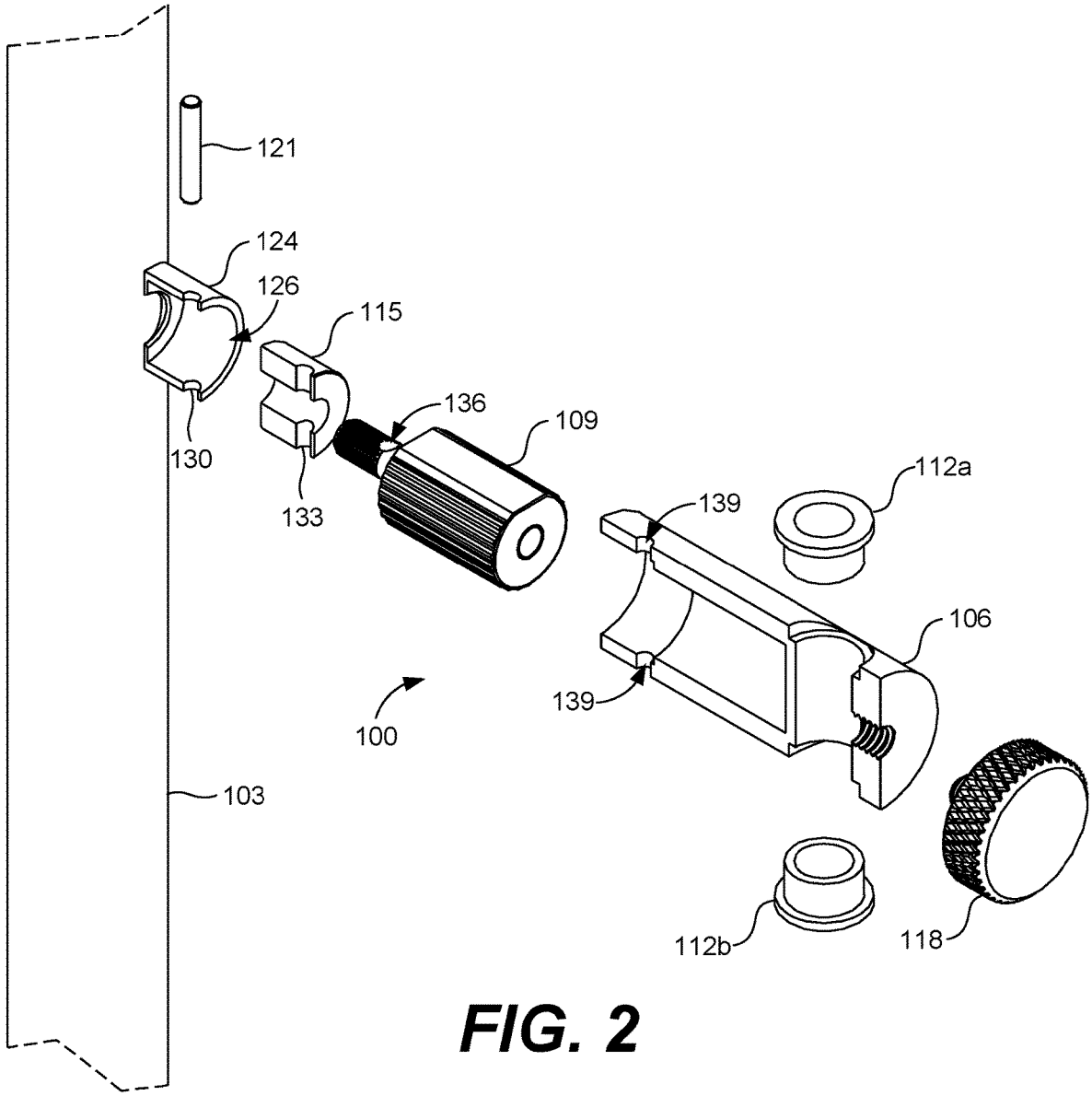
FIG. 2 is an exploded cross-section view of the friction hinge coupled to the food display post according to various embodiments of the present disclosure.
Figure 3:
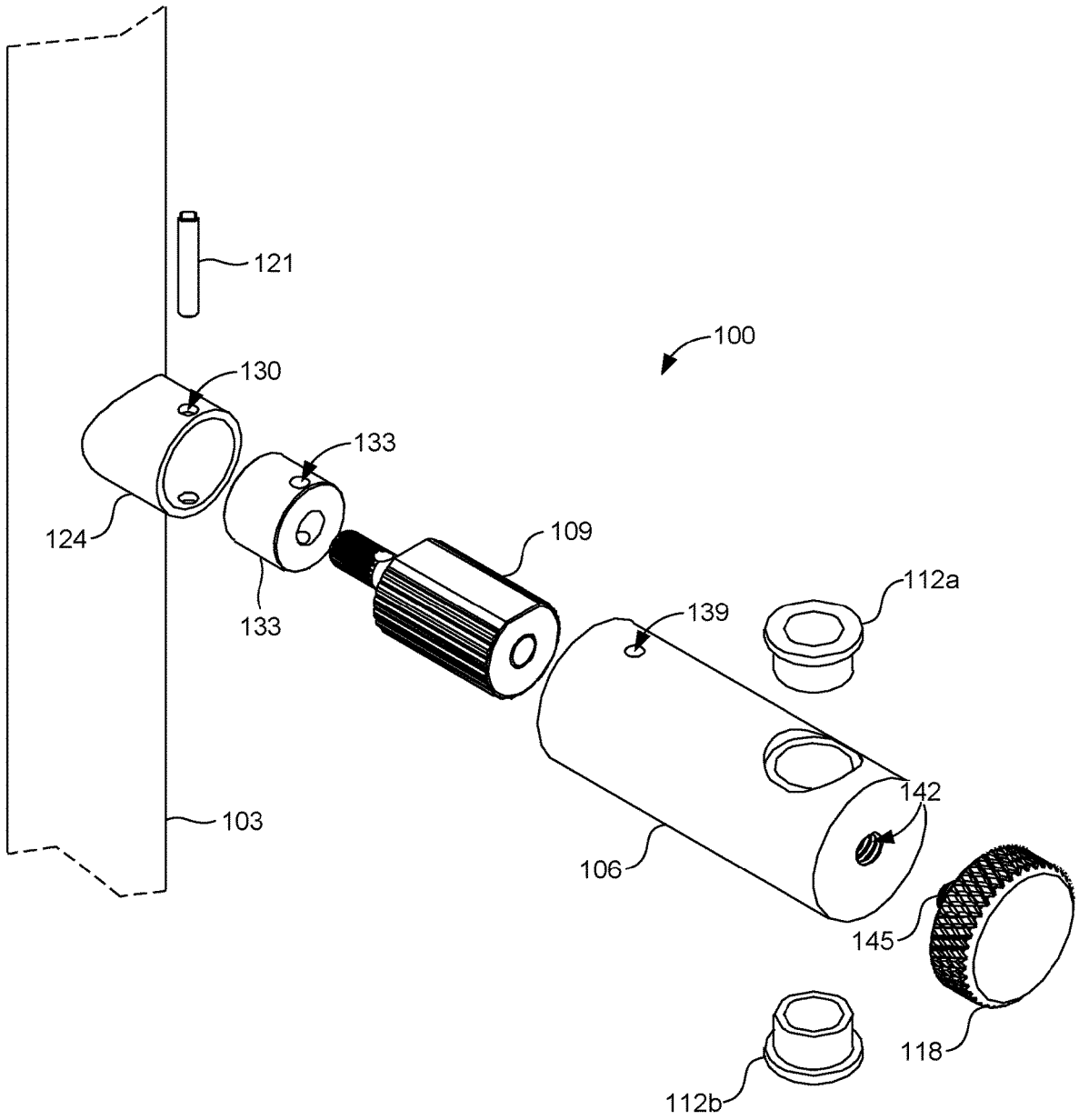
FIG. 3 is an exploded view of the friction hinge coupled to the food display post according to various embodiments of the present disclosure.

Various embodiments for a breath guard, sneeze guard, or food display having a friction hinge are disclosed. Turning now to FIGS. 1, 2, and 3, a perspective cross-section view of a friction hinge 100 coupled to a food display post 103 and two exploded perspective views of the same are shown, respectively, with FIG. 2 being an exploded cross-section view according to various embodiments. As can be appreciated, the friction hinge 100 can be coupled to the food display post 103 for purposes of adjusting or moving panels of a food display (not shown) to form various arrangements suitable for use as a shield to prevent contamination as well as for cleaning, food removal, etc., while not requiring adjustment of one or more locking mechanisms. Hence, the use of the friction hinge 100 in a food display allows a panel or other component to remain in a stationary and secure position without having to engage or disengage a lock or other locking mechanism. As such, the embodiments described herein are directed towards improvements over conventional food display systems.

According to various embodiments, the friction hinge 100 can include, for example, a hinge housing 106, a torque cartridge 109, one or more slide rod bushings 112*a*, 112*b* (collectively "slide rod bushings 112"), a hinge base bushing 115, a thumb screw 118, a set pin 121, as well as other components as will be described. The food display post 103, which can include one of many posts on a food display, can include a housing sleeve 124 coupled to or integrated with the food display post 103 via welding or other suitable coupling technique.

As shown in FIGS. 1, 2, and 3, the housing sleeve 124 defines an opening 126 having a diameter substantially similar to an outer diameter of the hinge base bushing 115 such that the hinge base bushing 115 can be coupled to and received in the opening 126. In this regard, an exterior of the hinge housing 106 covers at least a portion of the housing sleeve 124 when the hinge base bushing 115 is positioned within the housing sleeve 124. As shown in the cross-section view of FIG. 1, a surface of the housing sleeve 124 is positioned between surfaces of the hinge housing 106 and the hinge base bushing 115, as shown in the cross-section view of FIG. 1.

The housing sleeve 124 can further include sleeve receptacles 130 that vertically align with hinge base pin receptacles 133, torque hinge receptacles 136, and hinge body receptacles 139, for instance, when the hinge base bushing 115 is positioned into the opening 126 of the housing sleeve 124, as shown in the cross-section view of FIGS. 1 and 2. The friction hinge 100 can be coupled and secured to the food display post 103 by insertion of the set pin 121 through at least one of the base pin receptacles 130, the hinge base pin receptacles 133, the torque hinge receptacles 136, and the hinge body receptacles 139. In some embodiments, the set pin 121 can have a length substantially similar to an outer diameter of the hinge base bushing 115. As shown in the cross-section view of FIG. 1, the set pin 121 (e.g., FIG. 2), when inserted, can be positioned to be substantially flush with the sleeve receptacles 130 when the set pin 121 is positioned in the sleeve receptacles 130 (and other aligned receptacles). As such, the set pin 121 provides a mechanical interference that prohibits a rotation of the hinge base bushing 115 when force is applied to the hinge housing 106 (e.g., in response to a rotation of the hinge housing 106). As the set pin 121 has a length that does not exceed past the sleeve receptacles 130, the set pin 121 does not mechanically interfere with a rotation of the friction hinge 100 relative to the food display post 103. In other words, the hinge housing 106 of the friction hinge 100 is permitted to rotate independent of the hinge base bushing 115 and the housing sleeve 124.

The hinge housing 106 can include an elongated cylindrical body. Referring to FIG. 3, in one embodiment, the hinge housing 106 can include a female threaded aperture 142 positioned on an end surface of the hinge housing 106 opposite that of the food display post 103. The female threaded aperture 142 can couple to a male threaded projection 145 of the thumb screw 118, as can be appreciated. As the one or more slide rod bushings 112 may house a slide rod (not shown), the thumb screw 118 can be tightened to secure a position of the slide rod relative to the friction hinge 100 and the food display post 103, as will be discussed. The thumb screw 118 can be circular, as shown, or other shape suitable for rotation by an operator. Moreover, an exterior of the thumb screw 118 can be machined or textured to provide the operator with additional grip.

Referring back to FIG. 1, the hinge housing 106 can be sized and positioned to store an entirety of the torque cartridge 109 and the hinge base bushing 115 in a hollow interior of the hinge housing 106. When the torque cartridge 109 is positioned in the interior of the hinge housing 106, a press fit can be formed between an outer surface of the torque cartridge 109 and an interior surface of the hinge housing 106. In other words, a mechanical interference is formed between the torque cartridge 109 and the hinge housing 106 such that, when a predetermined amount of force is applied, the torque cartridge 109 and the hinge housing 106 rotate in unison.

Figure 4:
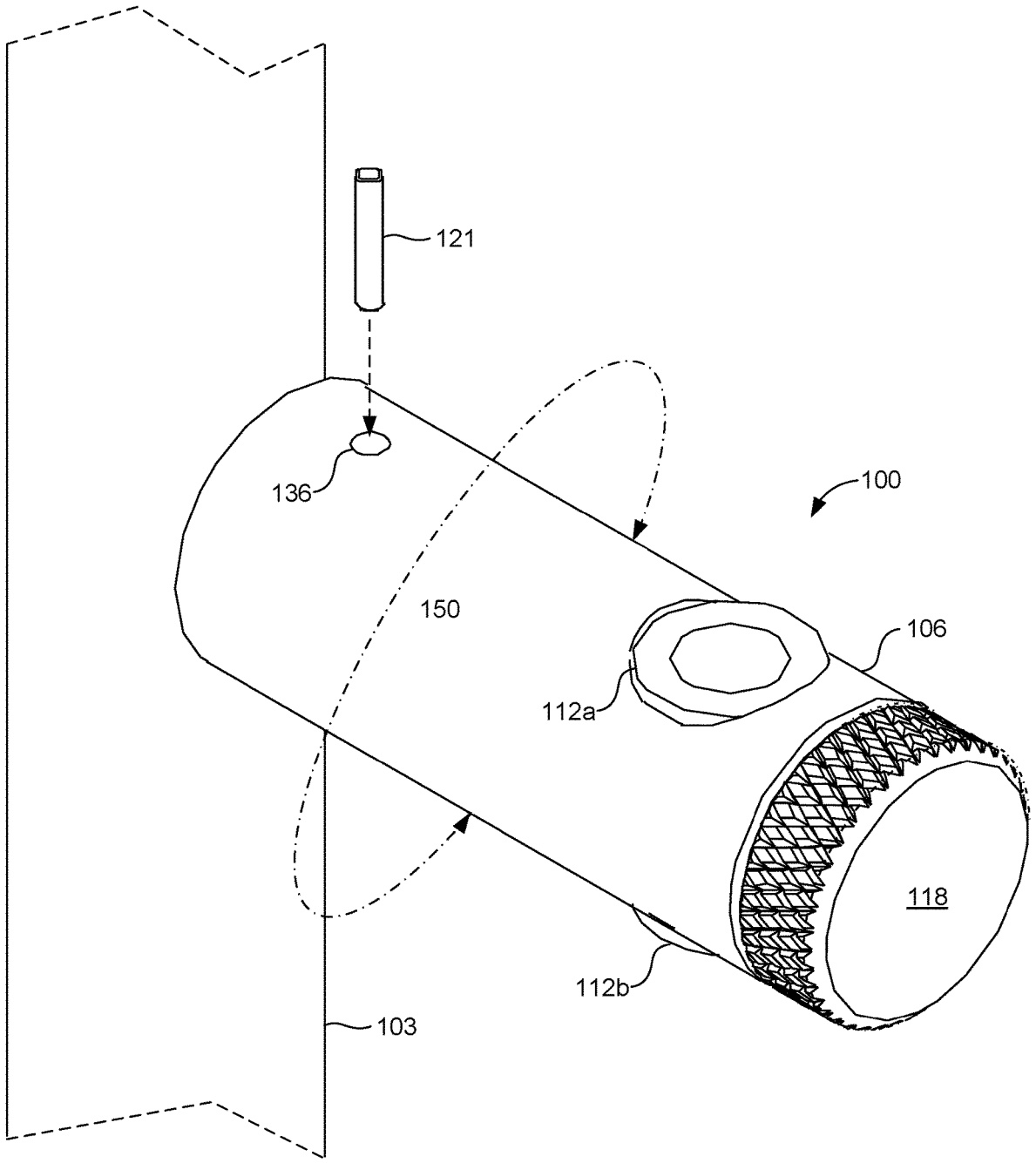
FIG. 4 is a perspective view of the friction hinge coupled to the food display post according to various embodiments of the present disclosure.

When the friction hinge 100 is positioned on the housing sleeve 124 to couple the friction hinge 100 to the food display post 103, the hinge housing 106 can receive the housing sleeve 124 in the hollow interior of the hinge housing 106, as shown in FIG. 4. Notably, FIG. 4 shows the components of the friction hinge 100 installed for use, with the exception of the set pin 121 being shown outside the friction hinge 100 for purposes of illustration. The set pin 121 can be inserted into the torque hinge receptacle 136 and other aligned receptacles to couple the friction hinge 100 to the food display post 103, as described above.

FIG. 4 also illustrates a degree of rotation 150 of the friction hinge 100 relative to the food display post 103. For instance, an operator can use his or her hand to twist the hinge housing 106 and the torque cartridge 109, assuming enough force is applied. Additionally, force can be applied by pushing or pulling a swivel rod (not shown) or a panel (not shown), as will be discussed. However, the hinge housing 106 and the torque cartridge 109 will follow the degree of rotation shown in FIG. 4, as can be appreciated. In any case, a panel can be capable of rotating about the friction hinge 100 when a predetermined amount of force is applied to the panel 100 that, for example, induces a predetermined amount of torque in the friction hinge 100.

Figure 5:
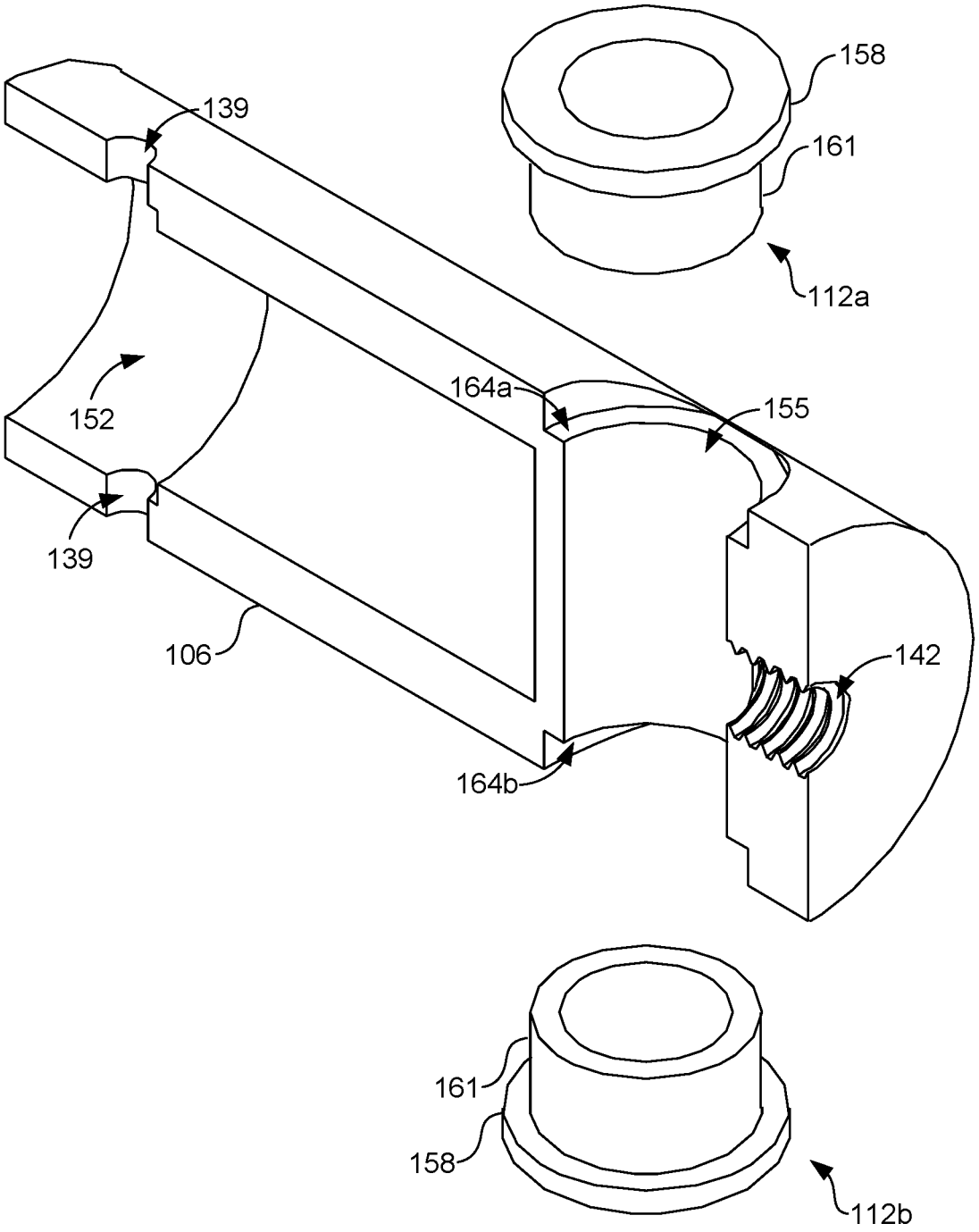
FIG. 5 is a perspective cross-section view of a hinge housing of the friction hinge according to various embodiments of the present disclosure.

An enlarged cross-section view of the hinge housing 106 is shown in FIG. 5 along with a first slide rod bushing 112*a* and a second slide rod bushing 112*b*. As noted above, the hinge housing 106 can include a hollow interior 152 that includes a section that substantially conforms to a shape of the torque cartridge 109 (e.g., FIG. 3), such that the torque cartridge 109 forms a mechanical interference with the hinge housing 106. Due to the mechanical interference, the torque cartridge 109 prevents a rotation of the hinge housing 106 unless a predetermined amount of force is applied.

The hinge housing 106 can further include a circular interior portion 155 having a channel that extends perpendicular to a length of the hinge housing 106, and the circular interior portion 155 being configured to receive the slide rod bushings 112 and a slide rod (not shown). The slide rod can have a diameter substantially similar to a hollow core of the slide rod bushings 112 such that the slide rod and the slide rod bushings 112 have a slip or sliding fit, while permitting the slide rod to traverse vertically in the circular interior portion 155 when a suitable amount of force is applied. When the slide rod bushings 112 are positioned in the circular interior portion 155 of the hinge housing 106, the slide rod bushings 112 can also permit a circular rotation of the slide rod relative to the hinge housing 106.

In some embodiments, the slide rod bushings 112 can include a flange 158 and a barrel 161 projecting from the flange 158. As shown in FIG. 5, the flange 158 can include a diameter greater than a diameter of the barrel 161, such that the barrel 161 and the circular interior portion 155 form a slight interference fit. The circular interior portion 155 of the hinge housing 106 can include ridges 164*a*, 164*b* (collectively "ridges 164") that provide a mechanical interference between a surface of the hinge housing 106 and the flange 158 of the slide rod bushings 112. The barrel 161 of the slide rod bushings 112, however, will project beyond the ridges 164 into the circular interior portion 155. In some embodiments, the diameter of the circular interior portion 155 is substantially similar to a diameter of the barrel 161 of the slide rod bushings 112.

Figure 6:
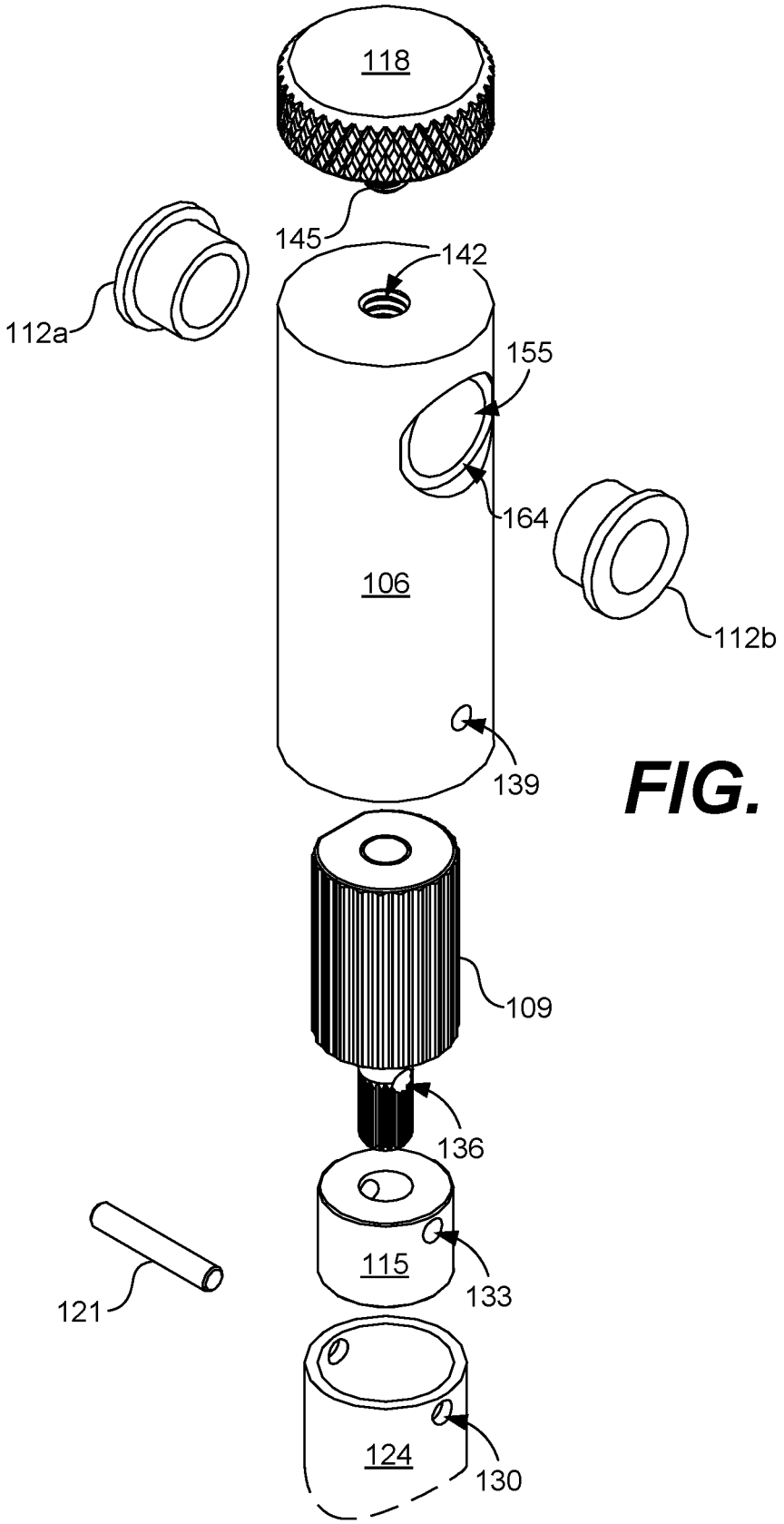
FIG. 6 is another exploded view of the friction hinge according to various embodiments of the present disclosure.

In some embodiments, the ridges 164 can be positioned at a depth that causes a top surface of the slide rod bushings 112 to be flush with a surface of the hinge housing 106. In other embodiments, the ridges 164 can be positioned at a depth such that a portion of the flange 158 extends above a surface of the hinge housing 106. An additional exploded view of the friction hinge 100 and its components is shown in FIG. 6 that further illustrates the ridges 164 relative to the circular interior portion 155 of the hinge housing 106.

Figure 7:
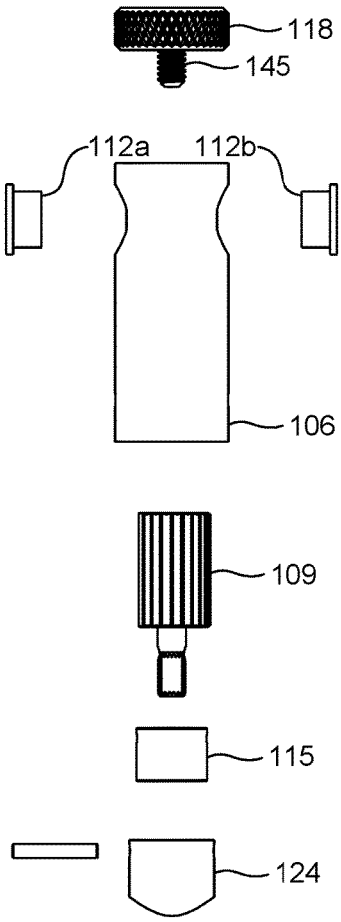
FIGS. 7-9 are cross-section views of the friction hinge according to various embodiments of the present disclosure.
Figure 8:
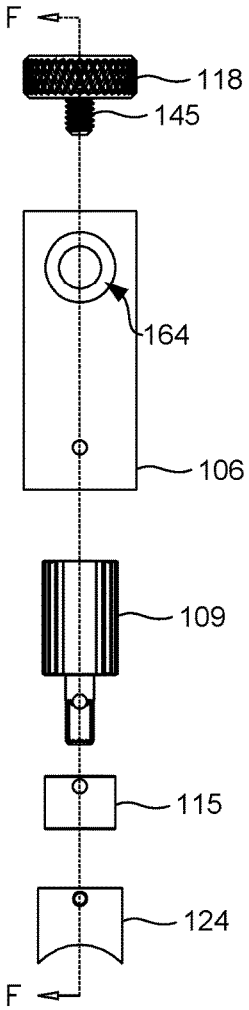
Figure 9:
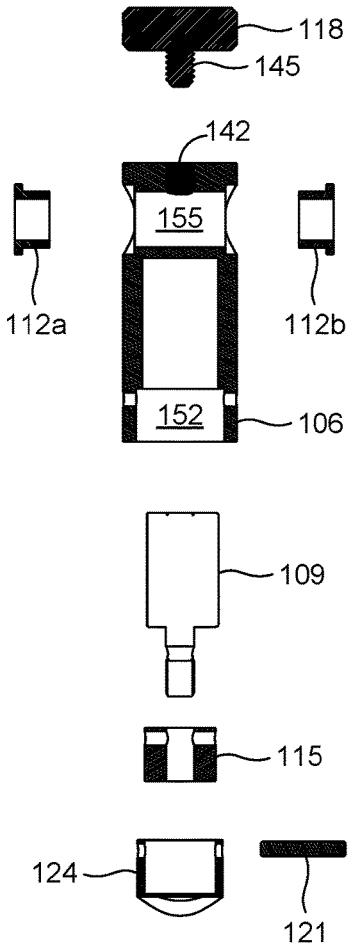

Additional exploded surface and cross-section views of the friction hinge 100, and the components described above, are shown in FIGS. 7, 8, and 9. For instance, with respect to FIG. 9, the female threaded aperture 142 of the hinge housing 106 can include a channel extending into the circular interior portion 155 of the hinge housing 106 that permits the male threaded projection 145 to come into contact with a slide rod positioned in the circular interior portion 155. By tightening the thumb screw 118, the male threaded projection 145 advances into the circular interior portion 155 coming into contact with a slide rod (not shown)

positioned therein. As such, the slide rod can be locked into place due to friction caused by the male threaded projection 145.

Figure 10:
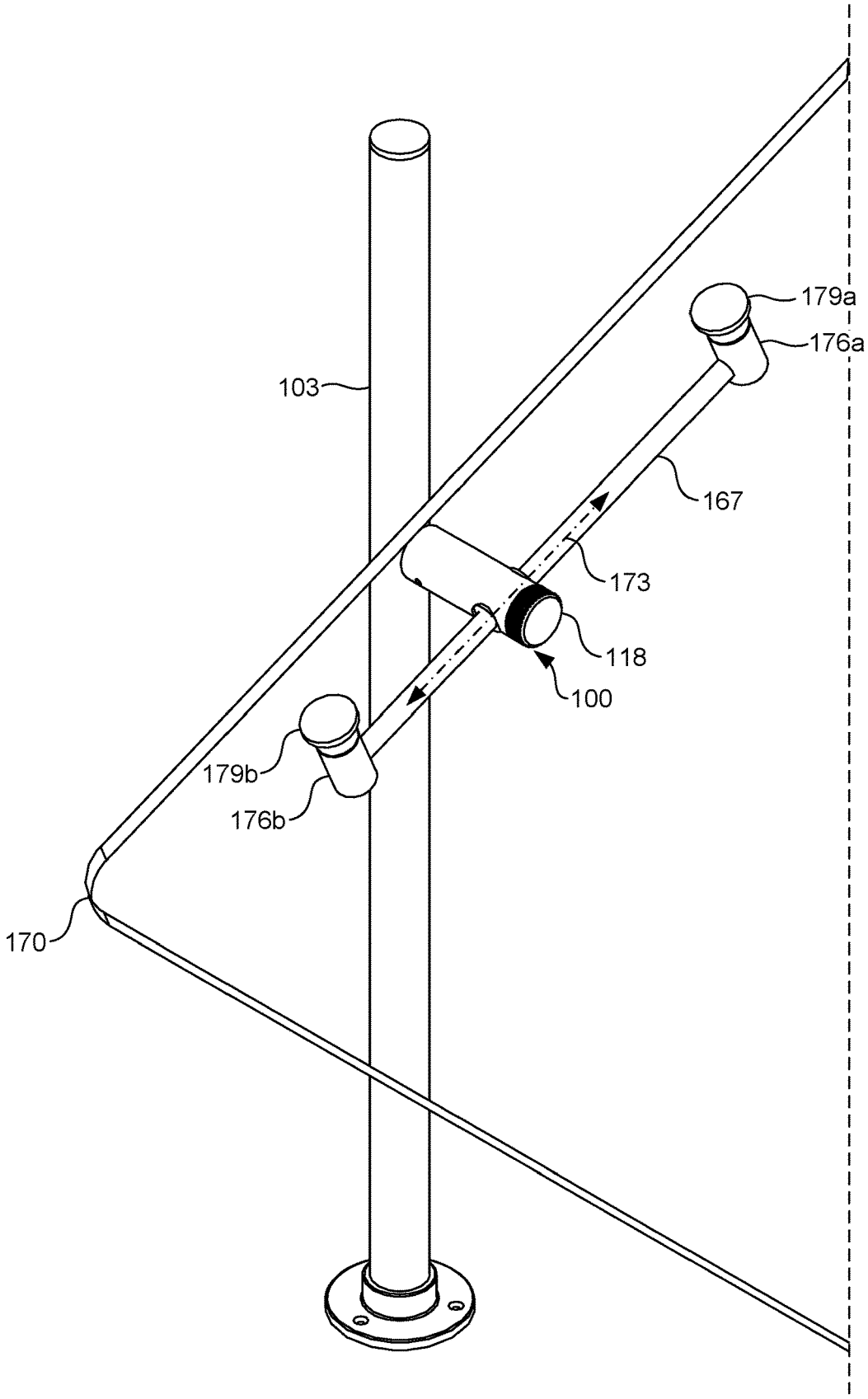
FIGS. 10, 11, 12A, 12B, 13, and 14 are perspective views of the friction hinge on various food displays according to various embodiments of the present disclosure.

Turning now to FIG. 10, another perspective view of the friction hinge 100 is shown along with a slide rod 167, a panel 170, and the food display post 103 according to various embodiments. The panel 170 can include, for instance, a plastic or a glass panel that is opaque, transparent, or partially transparent. The slide rod 167 can include, for instance, an elongated cylindrical body. As noted above, the slide rod 167 can be positioned in the slide rod bushings 112 such that the slide rod 167 can slide along an axis 173 parallel to the circular interior portion 155 to position the panel 170 in a suitable arrangement. The position of the slide rod 167 relative to the friction hinge 100 can be fixed, for instance, by tightening the thumb screw 118.

The slide rod 167 can extend along a width of the panel 170 to support various portions of the panel 170 or to support the panel 170 from various locations. To this end, distal ends of the slide rod 167 can be coupled to panel standoffs 176*a*, 176*b* (collectively "panel standoffs 176") that contact with and support an interior surface of the panel 170. For instance, the panel 170 can include apertures or openings (not shown) that allow a threaded connection to be formed between panel standoffs 176 and panel caps 179*a*, 179*b* (collectively "panel caps 179") positioned on an exterior surface of the panel 170. To this end, the panel 170 can include a first aperture for a first panel standoff 176*a* and a second aperture for a second panel standoff 176*b*, where a distance from the first aperture and the second aperture is substantially similar to a length of the slide rod 167.

In one embodiment, the panel standoffs 176 can include a screw-like device having a flange that can be hand-tightened into a threaded opening of the panel caps 179. As can be appreciated, when the panel caps 179 are coupled to the panel standoffs 176, the panel 170 is secured between the panel caps 179 and the panel standoffs 176. As such, a top or a bottom of the panel 170 can be pushed or pulled which, in turn, turns the hinge housing 106 and the torque cartridge 109 as desired to adjust a display angle of the panel 170 (assuming a suitable amount of force is applied). A height of the panel relative to the food display post 103 can be adjusted via the slide rod 167 and the thumb screw 118.

Figure 11:
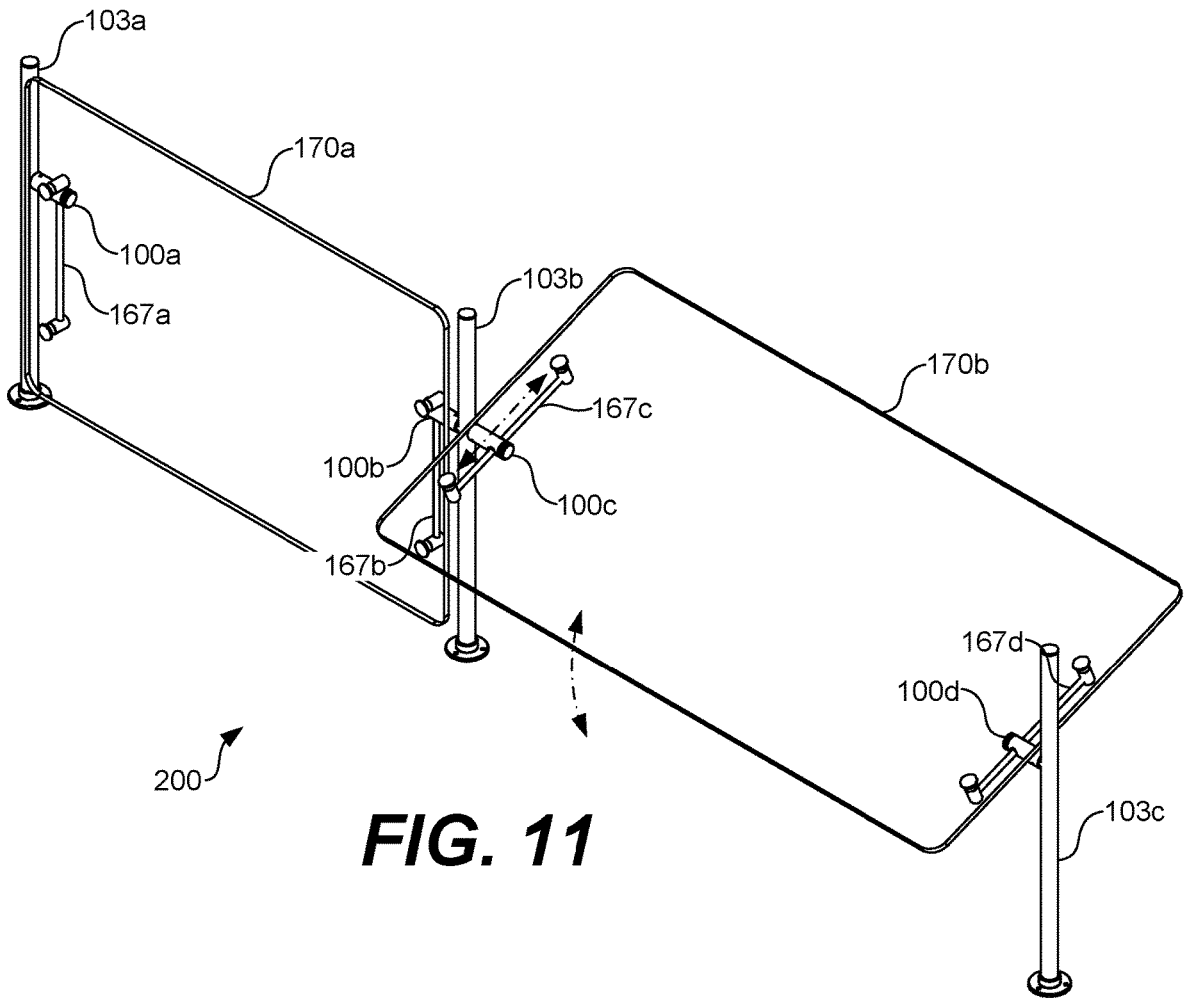

Moving on to FIG. 11, a food display 200 is shown that includes a plurality of friction hinges 100*a* . . . 100*d* (collectively "friction hinges 100") according to various embodiments. The food display 200 includes, for instance, a first panel 170*a* and a second panel 170*b*. As shown in FIG. 11, the first panel 170*a* is secured to a first food display post 103*a* and a second food display post 103*b* via a first friction hinge 100*a* and a second friction hinge 100*b*. Similarly, the second panel 170*b* is secured to the second food display post 103*b* and a third food display post 103*c* via a third friction hinge 100*c* and a fourth friction hinge 100*d*. Notably, the second food display post 103*b* includes friction hinges 100*a*, 100*b* positioned on opposing sides of an elongated circular body.

FIG. 11 further illustrates how the panels 170 can be manipulated depending on a desired arrangement of the panels 170. For instance, the first panel 170*a* is shown in a closed position, where a first slide rod 167*a* and a second slide rod 167*b* are pulled downwards fully to lower a height of the first panel 170*a* relative to a bottom of the food display posts 103 (e.g., a table or a ground surface). Additionally, the first food panel 170*a* is shown fully rotated in a downwards direction to create a substantially flat barrier.

The second panel 170*b*, however, is shown partially opened. For instance, a third slide rod 167*c* and a fourth slide rod 167*d* coupled to the second panel 170*b* are adjusted different than those of the first panel 170*a*, thereby allowing the second panel 170*b* to have a greater distance from the table, ground, or other surface. Additionally, the second panel 170*b* has been rotated to create an angled barrier useful in permitting personnel to reach under the second panel 170*b* while preventing germs and other contaminants from breathing, sneezing, coughing, and similar activities. The second panel 170*b* can be pulled upwards if additional room is required to clean, remove, or place food positioned behind the second panel 170*b*. Alternatively, it can be pushed downwards to a closed position, similar to the first panel 170*a* shown in FIG. 11.

Figure 12A:
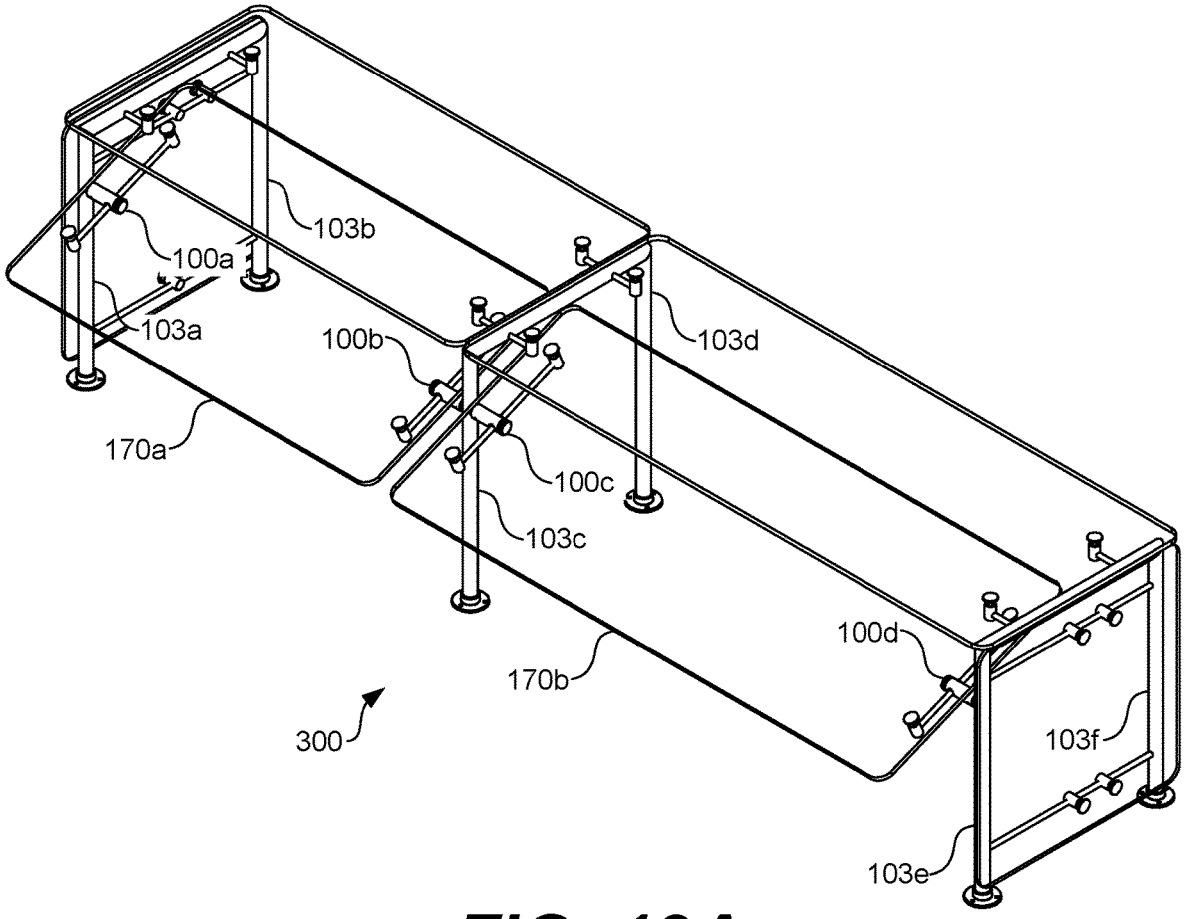
Figure 12B:
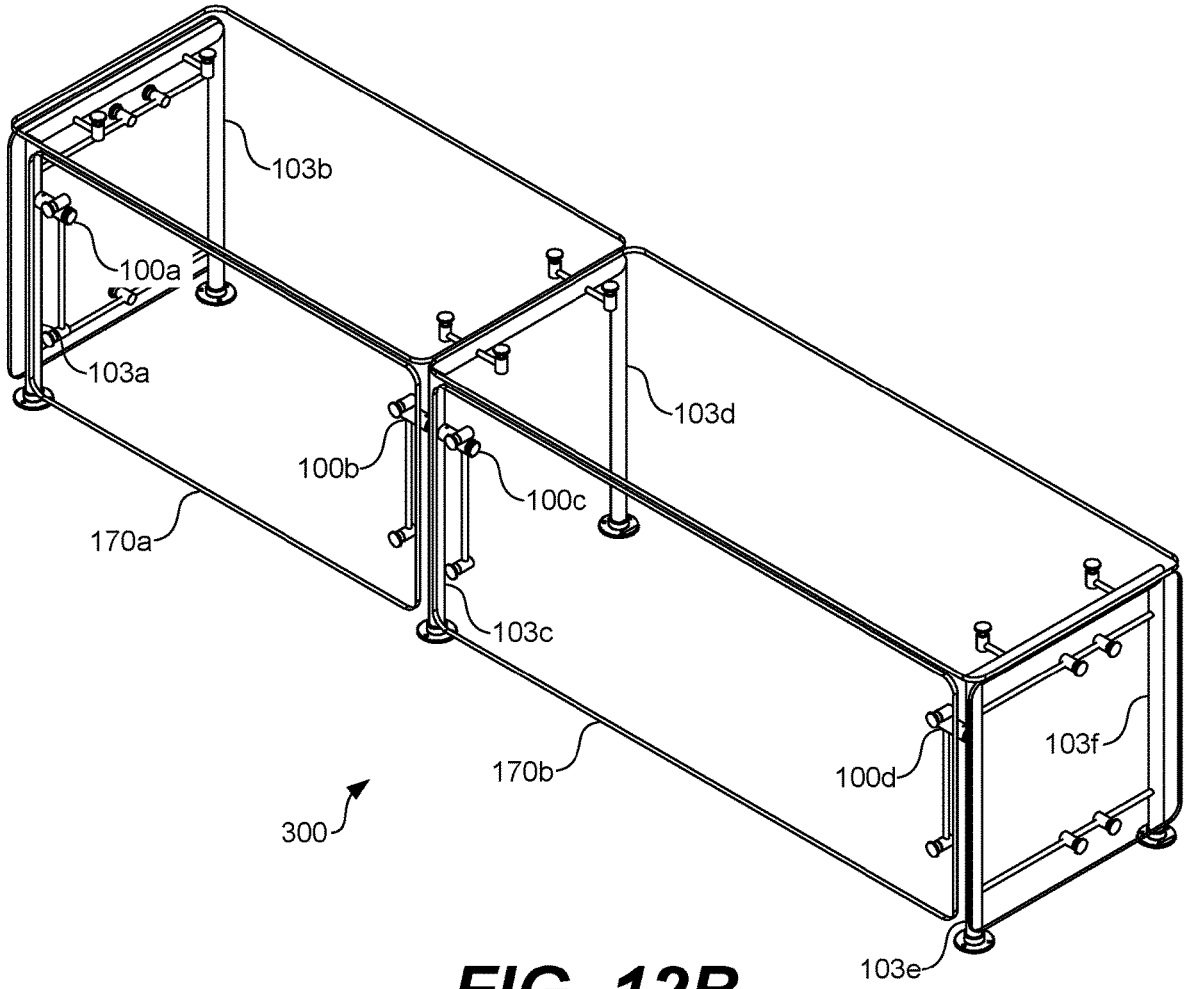

Moving on to FIGS. 12A and 12B, another embodiment of a food display 300 is shown that includes six posts 103*a* . . . 103*f*, two panels 170*a*, 170*b* utilizing four friction hinges 100*a* . . . 100*d*, as well as other stationary panels that can protect various portions of the food display 300 from contaminants. For instance, the food display 300 of FIGS. 12A and 12B includes side and top panels that shield an interior of the food display 300 from contaminants; however, access to the interior can be controlled by adjusting the panels 170*a*, 170*b* coupled to friction hinges 100*a* . . . 100*d* at a front of the food display 300. For instance, the panels 170*a*, 170*b* are shown in a partially opened state in FIG. 12A and a fully closed state in FIG. 12B.

Figure 13:
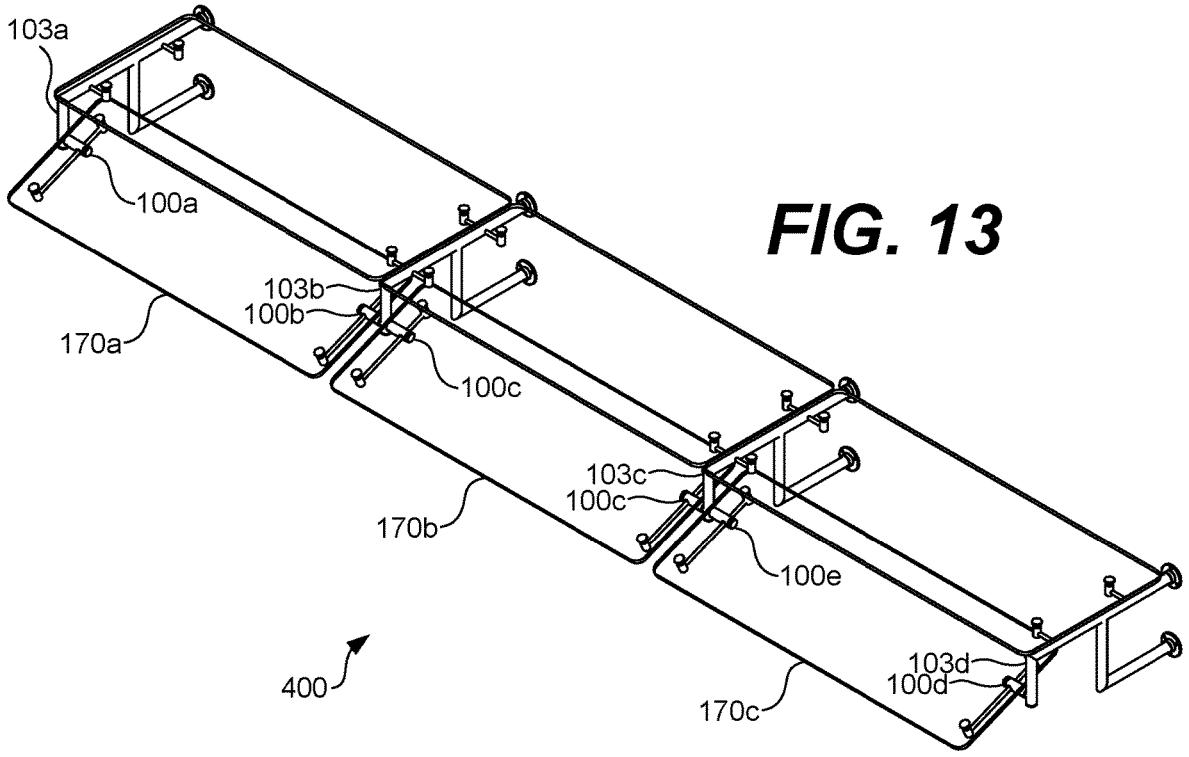

Referring next to FIG. 13, another embodiment of a food display 400 is shown that includes four food display posts 103*a* . . . 103*d* that can be mounted on a wall or similar surface. In this regard, the four food display posts 130*a* . . . 103*d* include a 90 degree bend, allowing a base of the food display posts 103 to be mounted horizontally on a vertical surface, such as a wall, post, or stud. The friction hinges 100*a* . . . 100*d* can be coupled to vertically disposed portions of the food display posts 103, as shown in FIG. 13. Moreover, the food display 400 can include top panels that shield an interior of the food display 400 from contaminants. Access to the interior can be controlled by adjusting the panels 170*a* . . . 170*c* coupled to friction hinges 100 at a front of the food display 400. For reference, the panels 170 in FIG. 13 are shown in a partially opened state.

Figure 14:
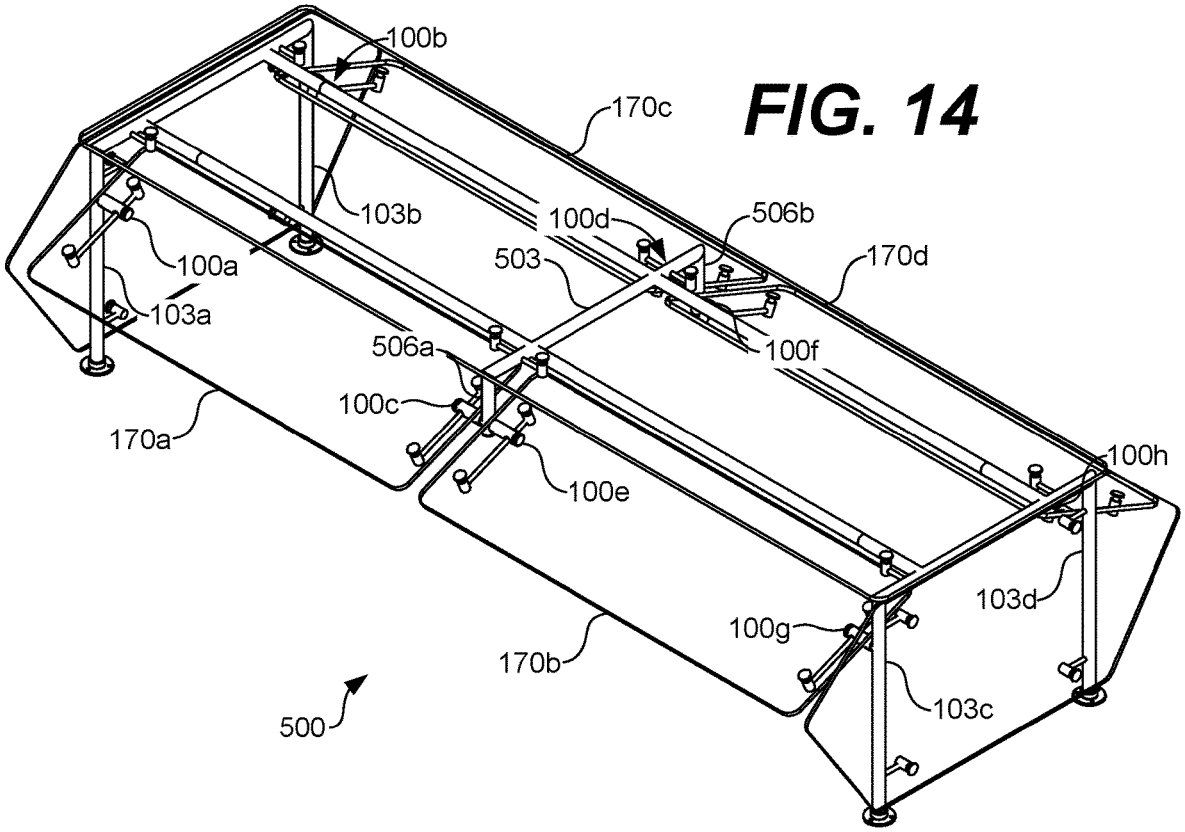

Moving on to FIG. 14, another embodiment of a food display 500 is shown that is double-sided or, in other words, includes panels 170*a* . . . 170*d* capable of adjustment on opposing sides of the food display 500. To this end, the food display 500 can include, for instance, four food display posts 103*a* . . . 103*d* and a suspension member 503. The suspension member 503 can include vertically extending portions 506*a*, 506*b* such that central ones of the friction hinges 103*c* . . . 103*f* can be mounted on opposing sides of the vertically extending portions 506*a*, 506*b*.

Moreover, the food display 500 can include top and side stationary panels that shield an interior of the food display 500 from contaminants. Access to the interior can be controlled by adjusting the panels 170*a* . . . 170*d* coupled to friction hinges 100*a* . . . 100*h* at a front and a rear side of the food display 500. For reference, the panels 170*a* . . . 170*d* in FIG. 14 are shown in a partially opened state.

Figure 15:
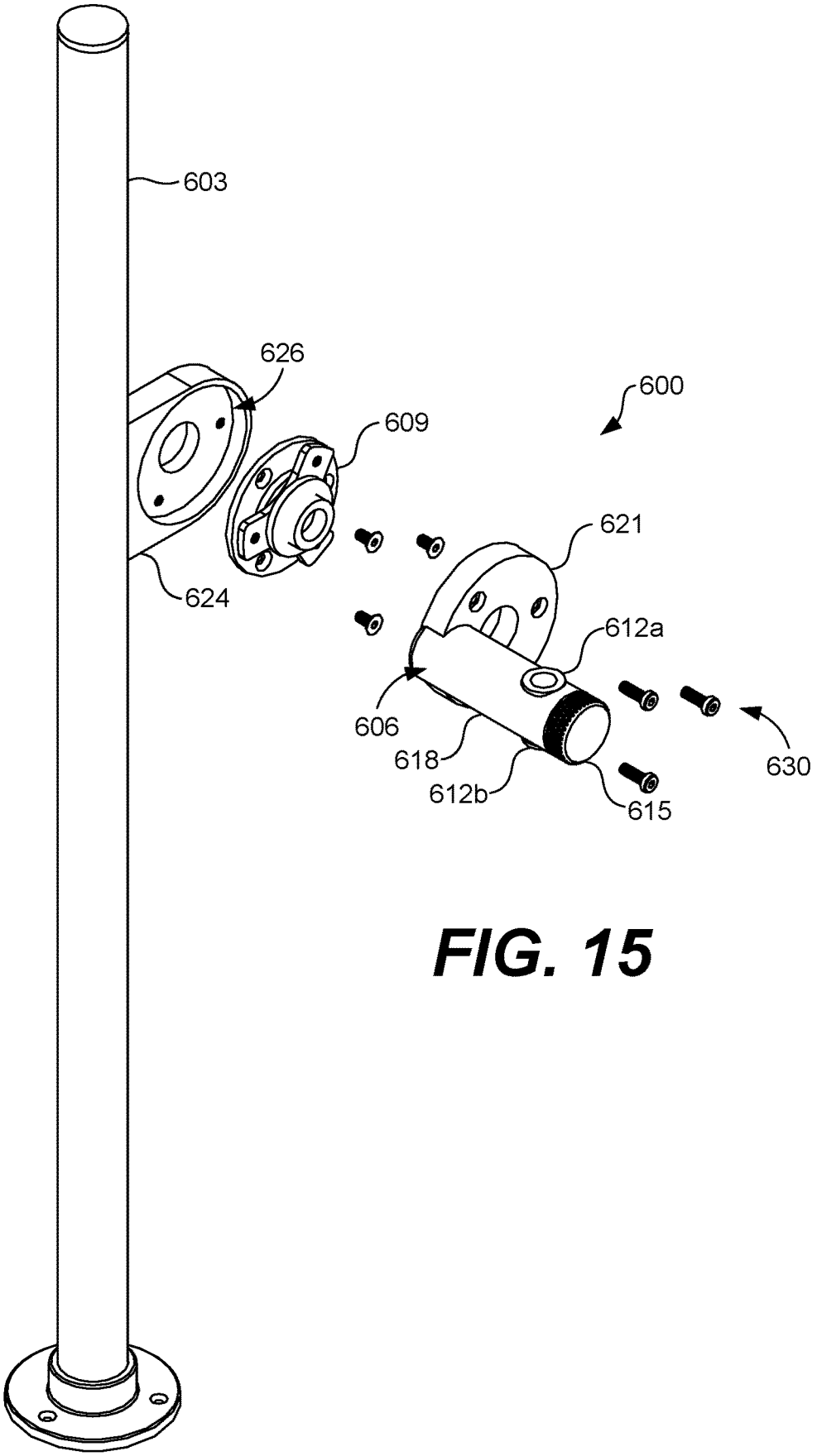
FIG. 15 is an exploded perspective view of another embodiment of the friction hinge coupled to the food display post according to various embodiments of the present disclosure.
Figure 16:
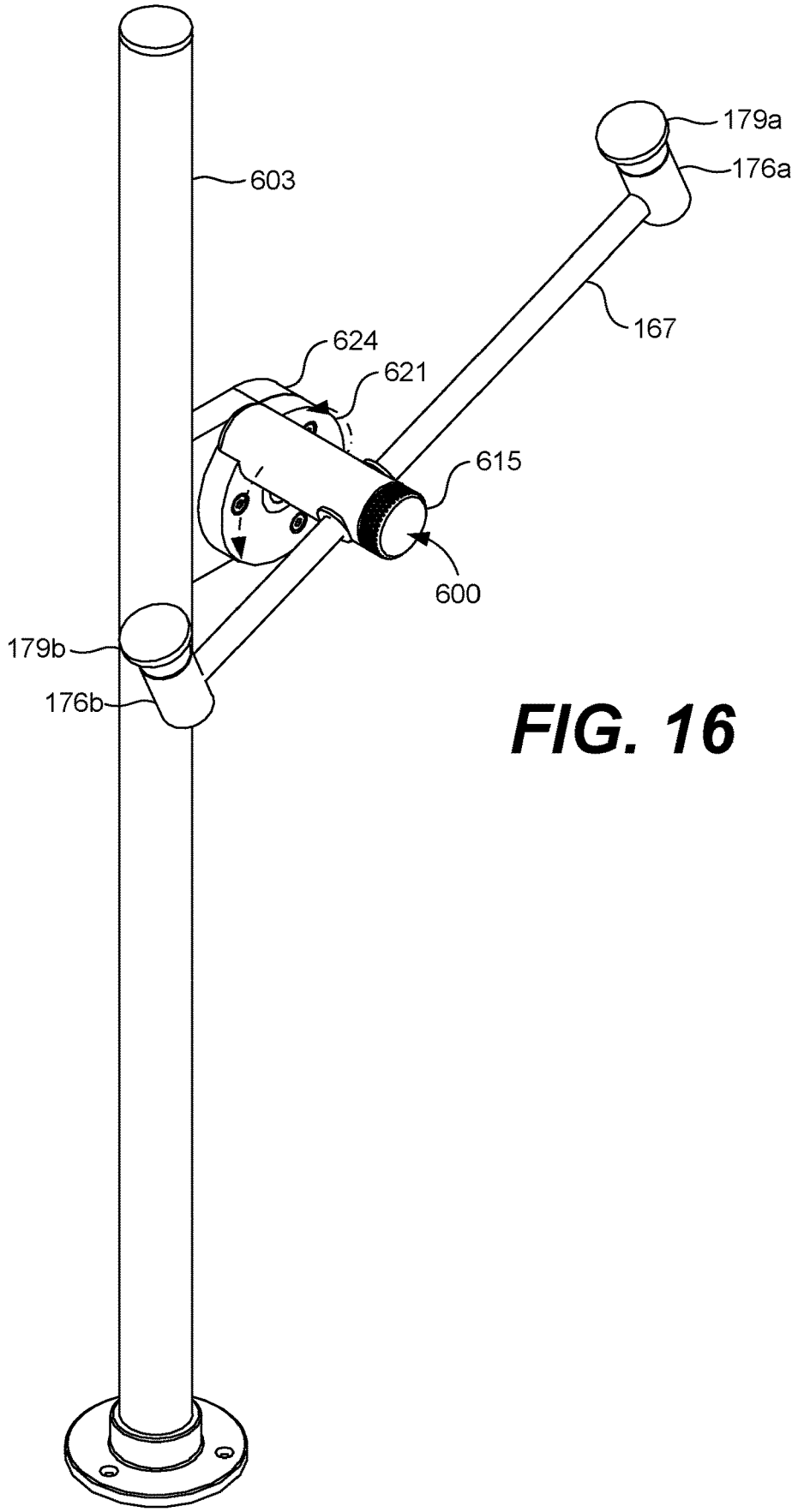
FIGS. 16, 17A, and 17B are perspective views of another embodiment of the friction hinge coupled to the food display post according to various embodiments of the present disclosure.

Referring next to FIGS. 15 and 16, an exploded view of another embodiment of a friction hinge 600 configured to be coupled to a food display post 603 is shown according to various embodiments. Similar to the embodiments described above, the friction hinge 600 can be coupled to the food display post 603 for purposes of adjusting or moving panels 170 of a food display to form various arrangements suitable for use as a shield to prevent contamination as well as for cleaning, food placement, food removal, etc., while not requiring adjustment of one or more locking mechanisms.

The friction hinge 600 can include, for example, a hinge housing 606, a swivel torque hinge 609, one or more slide rod bushings 612*a*, 612*b* (collectively "slide rod bushings 612"), and a thumb screw 615. The hinge housing 606 can include an elongated cylinder body 618 and a cylindrical hinge base 621. The food display post 603, which can include one of many posts on a food display, can include a housing sleeve 624 coupled to or integrated with the food display post 603. The housing sleeve 624 can include a semi-circular projection having a rectangular base extending from the food display post 603.

The housing sleeve 624 defines an opening 626 having a diameter substantially similar to a diameter of the swivel torque hinge 609 such that a rear portion of the swivel torque hinge 609 can be nested in and coupled to the housing sleeve 624. Similarly, the cylindrical hinge base 621 can include an opening (not shown) having a diameter substantially similar to a diameter of the swivel torque hinge 609 such that a forward facing portion of the swivel torque hinge 609 can be nested in and coupled to the hinge housing 606.

The swivel torque hinge 609 can include a rotation angle of 360 degrees of other suitable rotation angle. In some embodiments, the swivel torque hinge 609 can include a free stop function where the swivel torque hinge 609 can be stopped anywhere in its path of motion and friction will keep the swivel torque hinge 609 and the other components of the friction hinge 600 in a single position.

The hinge housing 606 can be coupled to the swivel torque hinge 609 via screws 630 or other suitable coupling mechanisms. Similarly, the swivel torque hinge 609 can be positioned in the opening 626 and coupled to the housing sleeve 624 via the screws 630 or other coupling mechanisms. While the hinge housing 606 shown in FIG. 15 does not include a torque cartridge 109, it is understood that the operation of the slide rod bushings 612*a*, 612*b* can operate consistent with the embodiments described above.

Figure 17A:
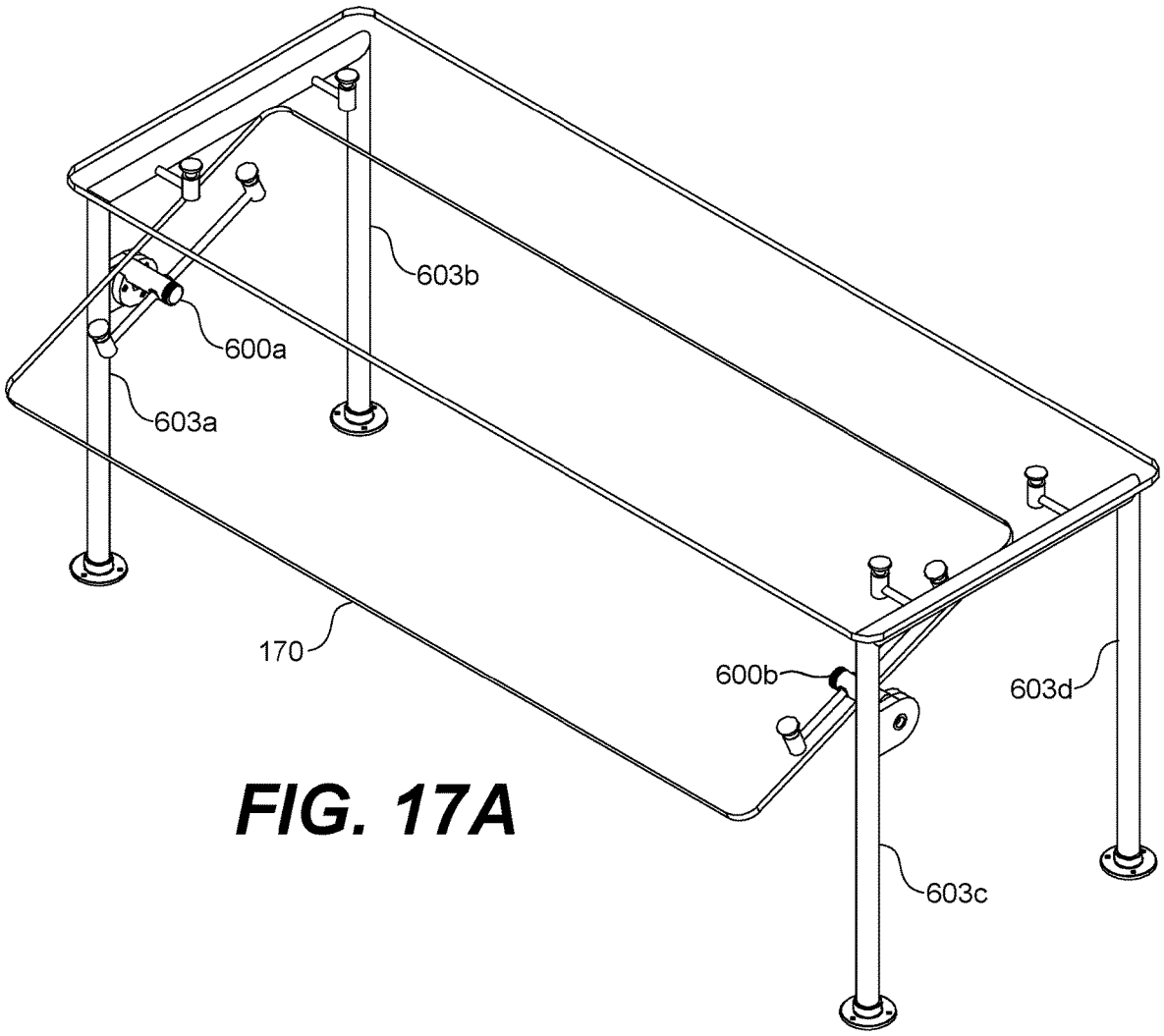
Figure 17B:
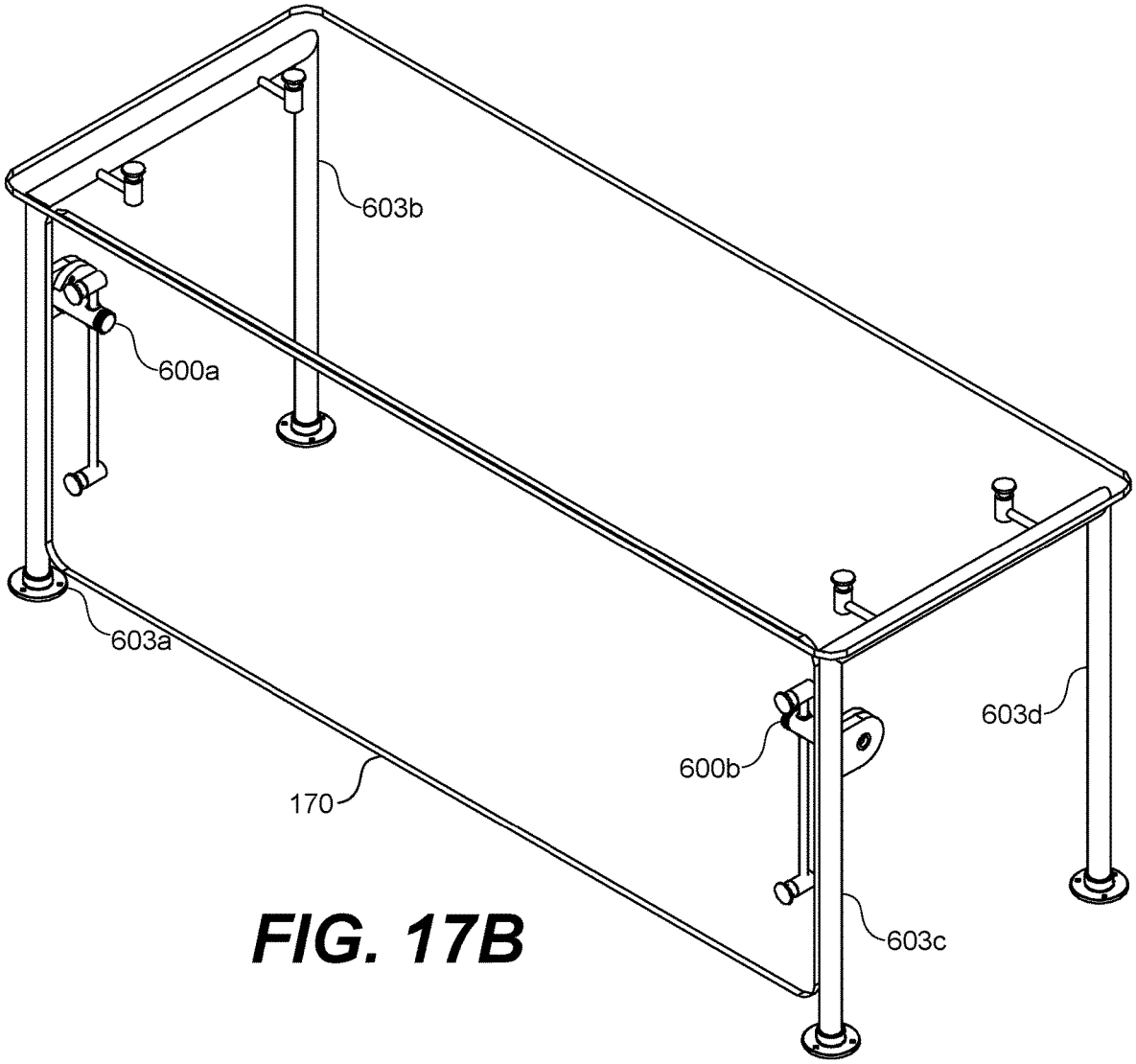

An assembled view of the friction hinge 600 is shown in FIG. 16 along with the slide rod 167, panel standoffs 176*a*, 176*b*, and panel caps 179*a*, 179*b*. In one embodiment, the panel standoffs 176 can include a screw-like device having a flange that can be hand-tightened into a threaded aperture of the panel caps 179. As can be appreciated, when the panel caps 179 are coupled to the panel standoffs 176, the panel 170 is secured between the panel caps 179 and the panel standoffs 176. As such, a top or a bottom of the panel 170 can be pushed or pulled which, in turn, turns the hinge housing 106 and the torque cartridge 109 as desired adjust a display angle of the panel 170 (assuming a suitable amount of force is applied). A height of the panel relative to the food display post 103 can be adjusted via the slide rod 167 and the thumb screw 118. The friction hinge 600 of FIGS. 15 and 16 are shown in embodiments for food displays in FIGS. 17A and 17B, shown in partially-opened and a partially-closed positions, respectively.

Figure 18:
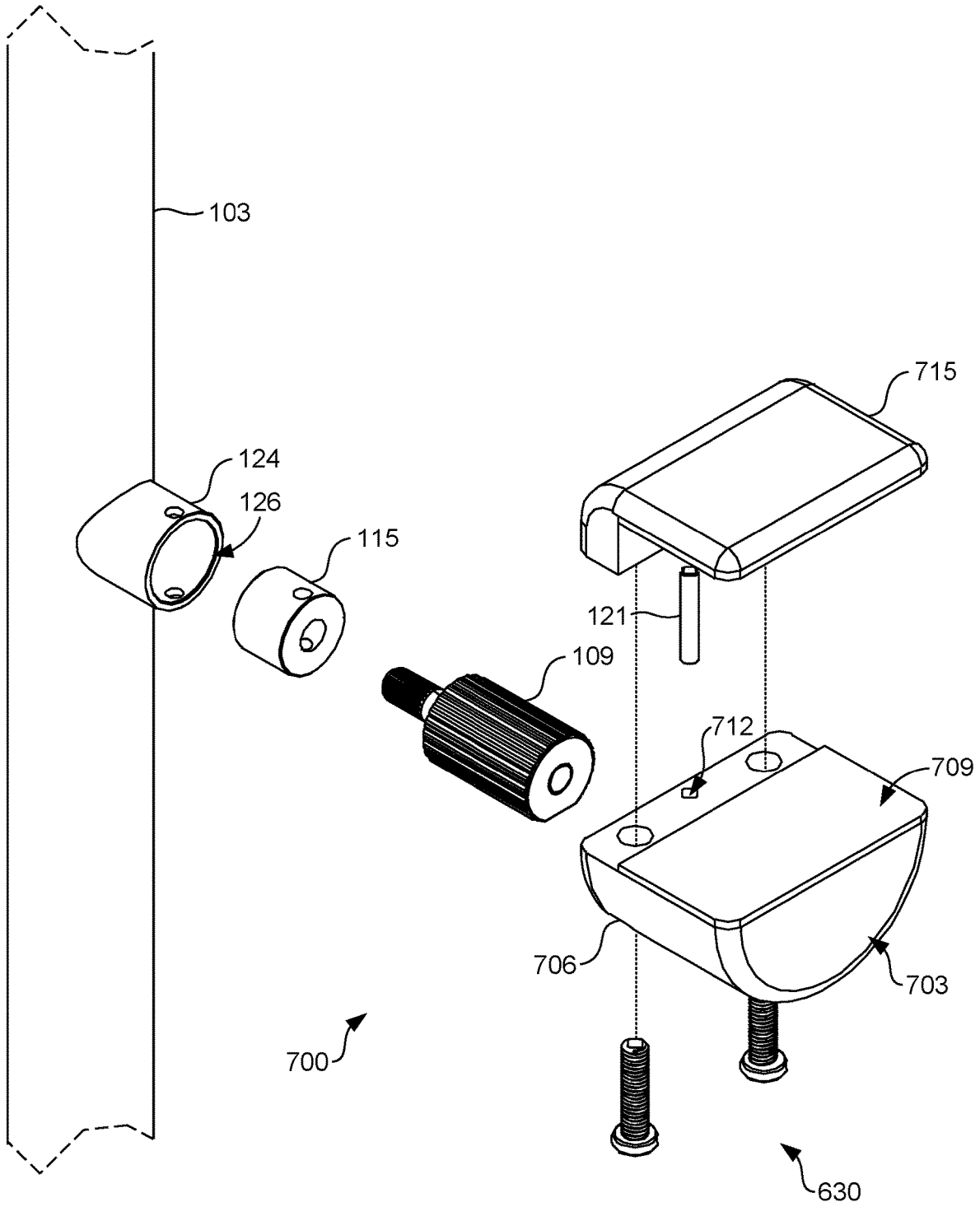
FIG. 18 is an exploded perspective view of another embodiment of the friction hinge coupled to the food display post according to various embodiments of the present disclosure.

Referring next to FIG. 18, an exploded perspective view of a friction hinge 700 configured to be coupled to the food display post 103 is shown according to various embodiments. The friction hinge 700 shown in FIG. 18 can include another style of housing to couple the friction hinge 700 to a panel 170 that may not require, for instance, the slide rod 167, the panel standoffs 176*a*, 176*b*, and the panel caps 179*a*, 179*b*. Instead, the friction hinge 700 can include, for example, a hinge housing 703 having, for instance, a semi-circular body 706. The semi-circular body 706 can include a flat ridge 709 that acts as a flat surface to come into contact with and support a surface of a panel 170. In some embodiments, the flat ridge 709 can be configured to come into contact with an edge of the panel 170. The hinge housing 703 can be configured to house the torque cartridge 109, the hinge base bushing 115, as well as other components, in a hollow core.

The friction hinge 700 can be coupled and secured to the food display post 103 by insertion of the set pin 121 through at least one of the sleeve receptacles 130 and hinge housing receptacles 712. As described above, the set pin 121 can provide a mechanical interference that prohibits a rotation of the hinge base bushing 115 when force is applied to the hinge housing 703 (e.g., in response to a rotation of the hinge housing 703). As the set pin 121 has a length that does not extend past the sleeve receptacles 130, the set pin 121 does not mechanically interfere with a rotation of the friction hinge 700 relative to the food display post 103. In other words, the hinge housing 106 of the friction hinge 700 is permitted to rotate independent of the hinge base bushing 115 and the housing sleeve 124.

Figure 19:
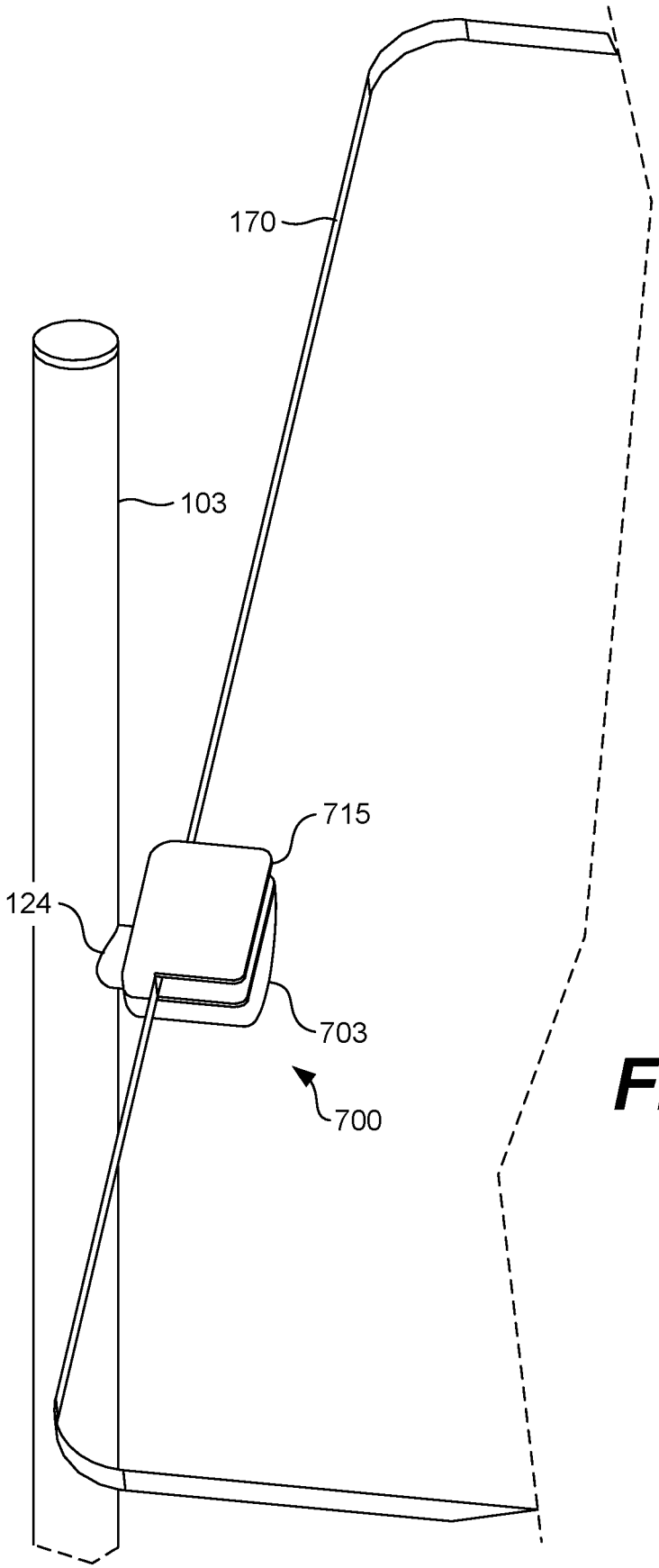
FIGS. 19 and 20 are perspective views of another embodiment of the friction hinge coupled to the food display post according to various embodiments of the present disclosure.
Figure 20:
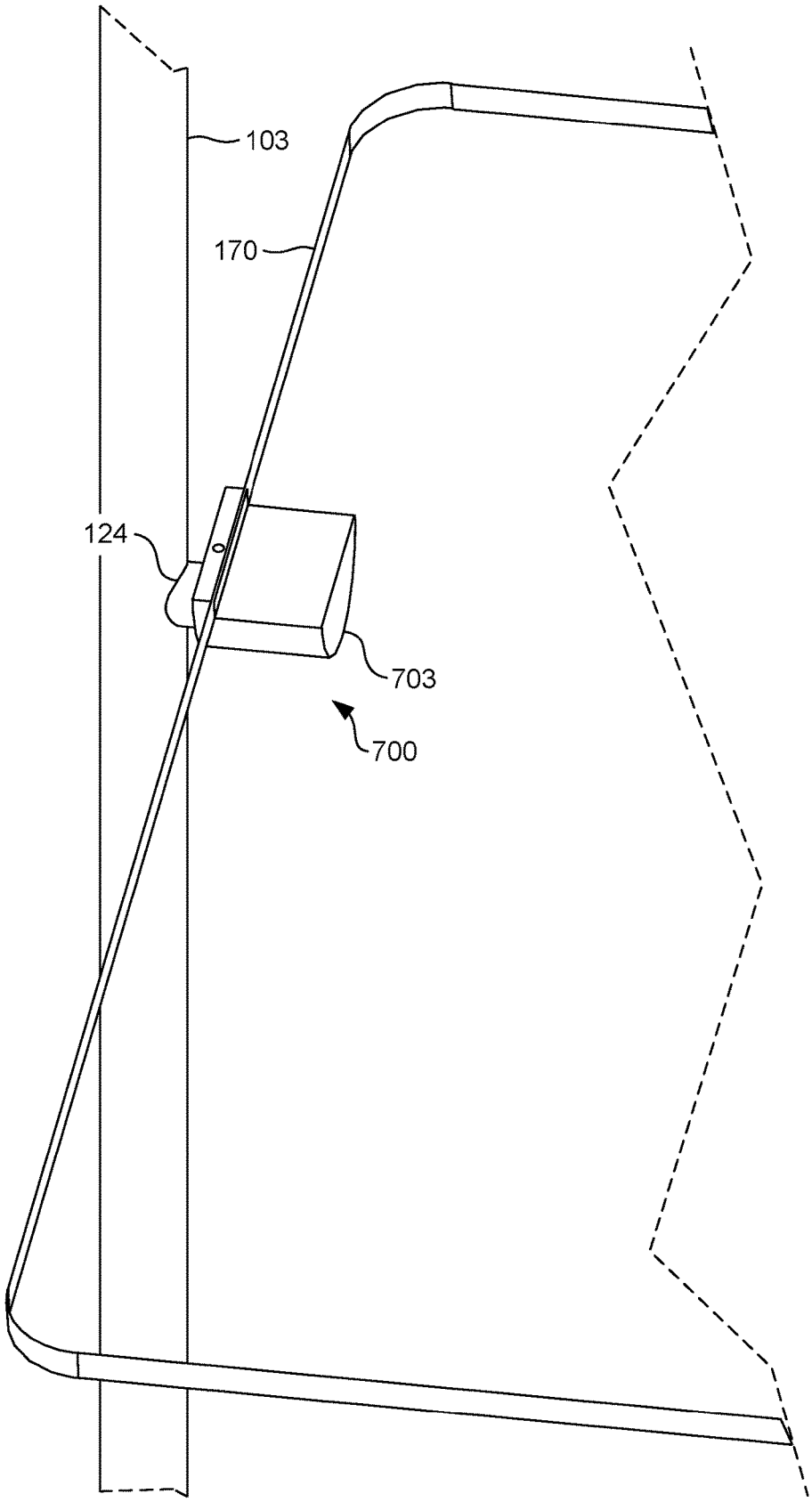

In some embodiments, a clamp 715 can be coupled to the hinge housing 703, while having the panel 170 between the clamp 715 and the hinge housing 703. As such, the clamp 715 can include a flat surface (not shown) as well that is configured to come into contact with the panel 170. FIG. 19 shows an example of a panel 170 being positioned between the clamp 715 and the hinge housing 703. FIG. 20, on the other hand, does not include the clamp 715. Instead, an adhesive glass attachment can be placed between the flat ridge 709 and the panel 170. In some embodiments, the adhesive glass attachment can include, for instance, an adhesive that is bonded to the hinge housing 703 and/or the panel 170 using ultraviolet light or heat. In some embodiments, the adhesive glass attachment can include a food-safe epoxy. As can be appreciated, an adhesive can be utilized if the binding properties of the material are stronger than the force required to engage the friction hinge 700.

Figure 21:
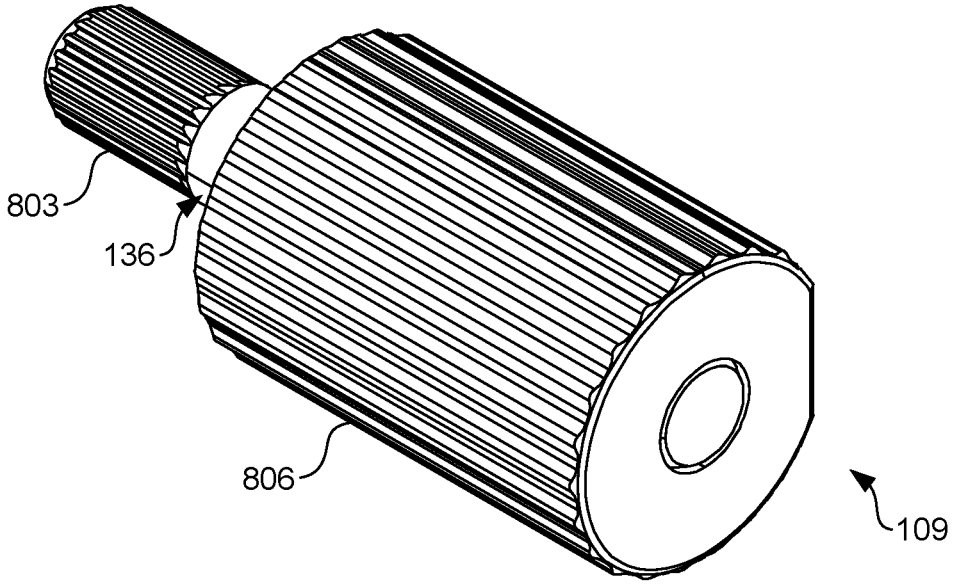
FIG. 21 is an enhanced view of a torque cartridge for use in the friction hinge according to various embodiments of the present disclosure.

Turning now to FIG. 21, an enlarged view of the torque cartridge 109 is shown according to various embodiments. The torque cartridge 109 can include, for example, a stationary knurled shaft 803 and a rotator torque housing 806. The stationary knurled shaft 803 can include, for example, the torque hinge receptacles 136, as shown in FIGS. 2 and 21. It is understood that the stationary knurled shaft 803 remains stationary in the hinge housing 106 and does not move while a predetermined amount of torque is being applied to the rotator torque housing 806.

In various embodiments, the torque cartridge 109 can include a hinge base, a pintle bushing, a pintle set pin, an annular leaf, a plurality of bushings (e.g., nylon bushings), a pintle having a plurality of annular friction rings attached thereto, a washer, a pintle screw, an annular cap, a retaining ring, a knob, or other components as can be appreciated. Additionally, the torque cartridge 109 can include a center shaft or pintle and annular friction rings. In some embodiments, the annular friction rings are tightly fit to the pintle such that there is a large amount of consistent and measurable friction exerted when the annular friction rings are rotated with respect to the pintle. The annular leaf can provide a mechanical way to and rotate the annular friction rings and a panel simultaneously while the pintle is fixed to the hinge base using the set pin 121.

Figure 22:
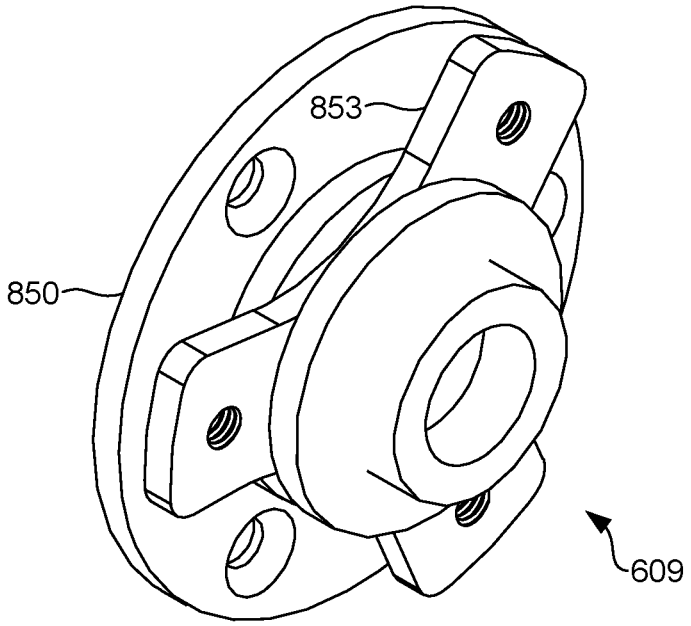
FIG. 22 is an enhanced view of a swivel torque hinge for use in the friction hinge according to various embodiments of the present disclosure.

Moving on to FIG. 22, an enlarged view of the swivel torque hinge 609 is shown according to various embodiments. The swivel torque hinge 609 can include, for example, a stationary base plate 850 and a rotator bracket 853, as can be appreciated. It is understood that the stationary base plate 850 remains stationary and does not move while a predetermined amount of torque is being applied to the rotator bracket 853. For instance, as the rotator bracket 853 rotates relative to the stationary base plate 850, a constant resistance torque is applied. As known in the art, the swivel torque hinge 609 includes a rotation angle of 360° and has a free stop function.

In accordance with the various embodiments described herein, the friction hinge 100, 600, 700 and its components can be mounted securely to a post or other portion of a structure using welding or other methods. The friction hinge 100, 600, 700 may provide means for rotating a panel 170 to various locations and have the panel 170 remain in place without an additional outside force or locking mechanism; though, in some embodiments, a locking set screw can be employed. The friction hinge 100, 600 can further be configured to provide a constant torque which results in enough resistance to hold the panel 170 at any desired position. The resistance is such that the panel 170, slide rod 167, and friction hinge 100, 600, 700 can be easily rotated by pressing or pulling on the panel 170 with a small amount of force (e.g., ~10-15 lbs. of force or other desired amount).

Figure 23A:
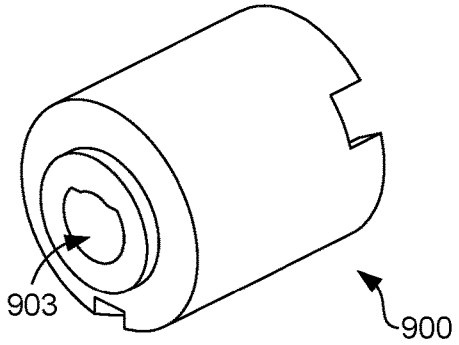
FIGS. 23A-23D are various views of a slip device for use in a friction hinge of a food display according to various embodiments of the present disclosure.
Figure 23B:
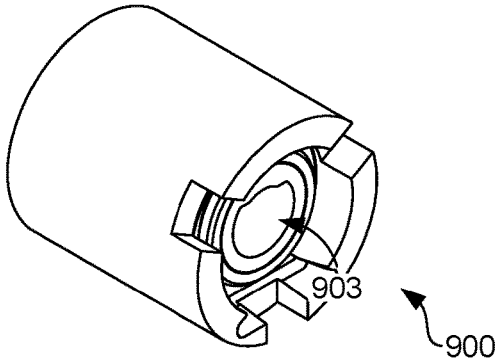
Figure 23C:
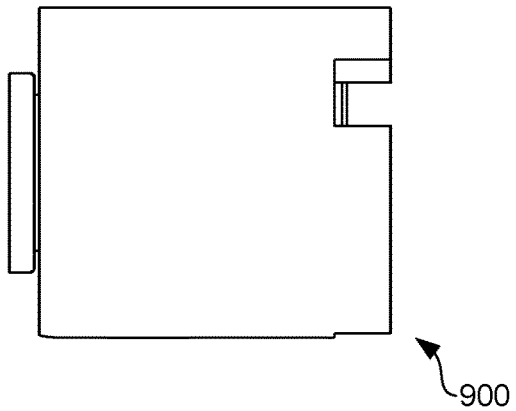
Figure 23D:
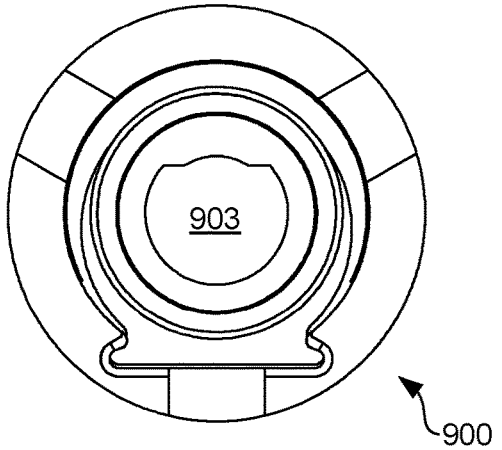

Referring now to FIGS. 23A-23D, a non-limiting example of a slip device 900 is shown according to various embodiments. The slip device 900 may be implemented in a food display 200 in some embodiments, as will be described. As can be appreciated, slip devices 900 provide an in-line constant torque, which can increase the life of clutch components included therein by reducing the engagement shock due to inertia and friction. In other words, the slip devices 900 can operate similar to the torque cartridge 109. Slip devices 900 can also be used to provide 360 degrees of rotation for use in various arrangements of a food display 200. A perspective front view of the slip device 900 is shown in FIG. 23A while a perspective rear view of the slip device 900 is shown in FIG. 23B. A side view of the slip device 900 is shown in FIG. 23C and a rear view of the slip device 900 is shown in FIG. 23D.

The slip device 900 may be included as a component of the hinge housing 106, for instance, in place of the torque cartridge 109, such that the front of the slip device 900 faces a food display post 103 while the rear of the slip device 900 faces the slide rod bushings 112. The slip device 900 can also be fixed to an interior surface of the hinge housing 106, similar to the torque cartridge 109 as described above.

Figure 23E:
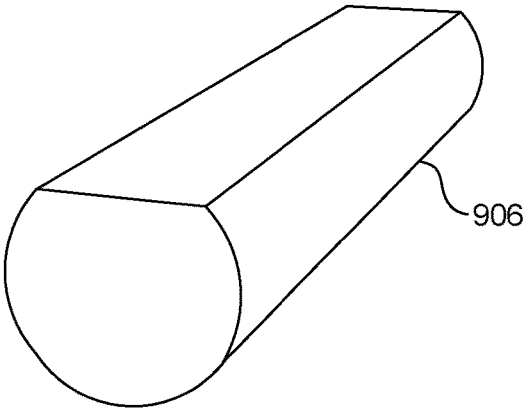
FIG. 23E is a perspective view of a D-profile rotary shaft for use with the slip device of FIGS. 23A-23D according to various embodiments of the present disclosure.

The slip device 900 can include a D-profile aperture 903 (or other suitable aperture) configured to receive or couple to a D-profile rotary shaft 906, shown in FIG. 23E, which also can be referred to as a D-shaft. Notably, the D-profile rotary shaft 906 has a semi-circular or partially-circular body with a flat surface. A first end of the D-profile rotary shaft 906 can be coupled to a food display post 103 while a second end is then coupled to the slip device 900 fixed wholly or partially within the hinge housing 106. As the D-profile rotary shaft 906 is coupled to the food display post 103, the D-profile rotary shaft 906 is fixed and stationary. As such, the hinge housing 106 can slide over an opposing end of the D-profile rotary shaft 906 to receive the D-profile rotary shaft 906 in an interior of the D-profile aperture 903 and the hinge housing 106. As such, the hinge body 106 may rotate in unison with the slip device 900, while the D-profile rotary shaft 906 remains stationary during a rotation of the hinge body 106 and the slip device 900.

Disjunctive language such as the phrase "at least one of X, Y, or Z," unless specifically stated otherwise, is otherwise understood with the context as used in general to present that an item, term, etc., can be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

Therefore, the following is claimed:

1. A food display, comprising:
- a plurality of food display posts;
- a friction hinge attached to at least one of the plurality of posts, the friction hinge comprising:
  - a hinge housing;
  - a first slide rod bushing and a second slide rod bushing; and
  - a swivel torque hinge, comprising:
    - a stationary base plate; and
    - a rotator bracket that rotates relative to the stationary base plate that provides a constant resistance torque when the rotator bracket is rotated with respect to the stationary base plate;
- a slide rod supporting a panel, the slide rod being disposed in the first slide rod bushing and the second slide rod bushing;
- a thumb screw configured to lock the slide rod into a position relative to the friction hinge;
- a first panel standoff positioned at a first distal end of the slide rod;
- a second panel standoff positioned at a second distal end of the slide rod;
- the panel, wherein the panel comprises a first aperture for the first panel standoff and a second aperture for the second panel standoff, wherein a distance between the first aperture and the second aperture is substantially similar to a length of the slide rod;
- a first panel cap configured to secure a first portion of the panel to the first panel standoff; and
- a second panel cap configured to secure a second portion of the panel to the second panel standoff, wherein the panel is capable of rotating about the friction hinge when a predetermined amount of force is applied to the panel that induces a predetermined amount of torque in the friction hinge.

2. The system of claim 1, further comprising a housing sleeve coupled to the food display post.

3. The system of claim 2, wherein the housing sleeve defines an opening having a diameter substantially similar to a diameter of the swivel torque hinge such that a rear portion of the swivel torque hinge is nested in the opening of the housing sleeve and coupled to the housing sleeve.

4. The system of claim 3, further comprising a cylindrical hinge base, wherein the cylindrical hinge base comprises an opening having a diameter substantially similar to a diameter of the swivel torque hinge such that a forward facing portion of the swivel torque hinge is nested in the opening of the cylindrical hinge base and coupled to the hinge base.

5. The system of claim 1, wherein the swivel torque hinge comprises a rotation angle of 360 degrees.

6. The system of claim 1, wherein the swivel torque hinge comprises a free stop function such that the swivel torque hinge is configured to be stopped anywhere in a path of motion, with friction keeping the swivel torque hinge in a defined position.

7. A food display, comprising:

a plurality of food display posts;

a friction hinge attached to at least one of the plurality of posts, the friction hinge comprising a swivel torque hinge that provides friction when the swivel torque hinge is annularly rotated, the swivel torque hinge, comprising:

a stationary base plate; and a rotator bracket that rotates relative to the stationary base plate that provides a constant resistance torque when the rotator bracket is rotated with respect to the stationary base plate; and a panel coupled to the friction hinge, wherein the panel is capable of rotating about the friction hinge when a predetermined amount of force is applied to the panel that induces a predetermined amount of torque in the friction hinge.

8. The food display of claim 7, further comprising:

a first slide rod bushing and a second slide rod bushing positioned on opposing ends of a hinge housing of the friction hinge; and a slide rod disposed in the first slide rod bushing and the second slide rod bushing, the slide rod being configured to traverse an interior portion of the hinge housing when the panel is pulled upwards or pushed downwards.

9. The food display of claim 8, further comprising a thumb screw having a male threaded projection configured to come into contact with the slide rod in the interior portion to lock the slide rod in a position relative to the friction hinge.

10. The food display of claim 9, further comprising:

a first panel standoff positioned at a first distal end of the slide rod;

a second panel standoff positioned at a second distal end of the slide rod;

a first panel cap configured to secure a first portion of the panel to the first panel standoff; and a second panel cap configured to secure a second portion of the panel to the second panel standoff.

11. The food display of claim 7, wherein the panel is glass or plastic.

12. The food display of claim 7, further comprising a housing sleeve coupled to at least one of the plurality of food display posts.

13. The food display of claim 12, wherein the housing sleeve defines an opening having a diameter substantially similar to a diameter of the swivel torque hinge such that a rear portion of the swivel torque hinge is nested in the opening of the housing sleeve and coupled to the housing sleeve.

14. The food display of claim 13, further comprising a cylindrical hinge base, wherein the cylindrical hinge base comprises an opening having a diameter substantially similar to a diameter of the swivel torque hinge such that a forward facing portion of the swivel torque hinge is nested in the opening of the cylindrical hinge base and coupled to the hinge base.

15. The food display of claim 7, wherein the swivel torque hinge comprises a rotation angle of 360 degrees.

16. The food display of claim 7, wherein the swivel torque hinge comprises a free stop function such that the swivel torque hinge is configured to be stopped anywhere in a path of motion, with friction keeping the swivel torque hinge in a defined position.

17. A method, comprising:

providing a food display, wherein the food display comprises:

a plurality of food display posts;

a friction hinge attached to at least one of the plurality of posts, the friction hinge comprising a swivel torque hinge that provides friction when the swivel torque hinge is annularly rotated, wherein the swivel torque hinge comprises:

a stationary base plate; and a rotator bracket that rotates relative to the stationary base plate that provides a constant resistance torque when the rotator bracket is rotated with respect to the stationary base plate; and a panel coupled to the friction hinge, wherein the panel is capable of rotating about the friction hinge when a predetermined amount of force is applied to the panel that induces a predetermined amount of torque in the friction hinge.

18. The method of claim 17, wherein the food display as provided further comprises a housing sleeve coupled to at least one of the plurality of food display posts, wherein the housing sleeve defines an opening having a diameter substantially similar to a diameter of the swivel torque hinge such that a rear portion of the swivel torque hinge is nested in the opening of the housing sleeve and coupled to the hinge base.

19. The method of claim 18, wherein the food display as provided further comprises a cylindrical hinge base, wherein the cylindrical hinge base comprises an opening having a diameter substantially similar to a diameter of the swivel torque hinge such that a forward facing portion of the swivel torque hinge is nested in the opening of the cylindrical hinge base and coupled to the housing sleeve.

20. The method of claim 17, wherein:

the swivel torque hinge comprises a rotation angle of 360 degrees; and the swivel torque hinge comprises a free stop function such that the swivel torque hinge is configured to be stopped anywhere in a path of motion, with friction keeping the swivel torque hinge in a defined position.

* * * * *